US007805786B2

(12) United States Patent
Lambarth

(10) Patent No.: US 7,805,786 B2
(45) Date of Patent: Oct. 5, 2010

(54) RETRACTABLE HEAD AND FOOT SECTION PIVOTS FOR AN AMBULANCE COT

(75) Inventor: Clifford E. Lambarth, Portage, MI (US)

(73) Assignee: Stryker Corporation, Kalamazoo, MI (US)

( * ) Notice: Subject to any disclaimer, the term of this patent is extended or adjusted under 35 U.S.C. 154(b) by 447 days.

(21) Appl. No.: 11/891,277

(22) Filed: Aug. 9, 2007

(65) Prior Publication Data

US 2009/0039666 A1 Feb. 12, 2009

(51) Int. Cl.
*A47B 7/00* (2006.01)

(52) U.S. Cl. ..... 5/620

(58) Field of Classification Search ..... 5/627, 5/86.1, 600, 613, 611; 296/20
See application file for complete search history.

(56) References Cited

U.S. PATENT DOCUMENTS

| | | | | |
|---|---|---|---|---|
| 2,276,256 | A * | 3/1942 | Visness et al. | 403/97 |
| 3,886,606 | A * | 6/1975 | Bradford | 5/627 |
| 5,537,700 | A | 7/1996 | Way et al. | |
| 5,987,673 | A * | 11/1999 | Smith | 5/627 |
| 6,374,437 | B1 * | 4/2002 | Voelker | 5/600 |
| 6,942,226 | B2 * | 9/2005 | Walkingshaw | 280/5.22 |
| 2002/0170115 | A1 * | 11/2002 | Borders et al. | 5/600 |
| 2007/0056104 | A1 * | 3/2007 | Ferneau et al. | 5/611 |
| 2007/0169269 | A1 | 7/2007 | Wells | |
| 2009/0000035 | A1 * | 1/2009 | Awerbuch et al. | 5/627 |

FOREIGN PATENT DOCUMENTS

WO WO 2006/036980 A1 4/2006

* cited by examiner

*Primary Examiner*—Michael Trettel
*Assistant Examiner*—William Kelleher
(74) *Attorney, Agent, or Firm*—Flynn, Thiel, Boutell & Tanis, P.C.

(57) ABSTRACT

An ambulance cot has a wheeled base and a patient litter. The patient litter includes a pair of hollow, laterally spaced, longitudinally extending side rails, the side rails being configured to extend from a head end to a foot end of the patient litter. At least one retractable, generally U-shaped litter section with at least one hand grip is oriented thereon adjacent a bight portion thereof. The legs of the U-shaped litter section are configured to be slidably received into the interior of the respective longitudinally extending side rails, each of the parallel legs having first and second sections and a hinge configuration interconnecting them. A locking mechanism is provided for releasably locking the first and second sections together so as to prevent relative movement therebetween them and for unlocking the connection so as to permit a relative movement about an axis of the hinge configuration so that when the U-shaped litter section is in an extended position and the latch mechanism is in an unlocked condition, the first and second sections will be moveable with respect to one another to orient the hand grip at a different elevation.

7 Claims, 47 Drawing Sheets

RETRACTABLE HEAD AND FOOT SECTION PIVOTS FOR AN AMBULANCE COT

FIELD OF THE INVENTION

This invention relates to an ambulance cot and, more particularly, to an ambulance cot having retractable head and foot litter sections each configured to provide vertically adjustable hand grips for attendant use in lifting the ambulance cot.

BACKGROUND OF THE INVENTION

Emergency medical service (EMS) personnel are required to handle the combined weight of a patient and the ambulance cot during various stages of maneuvering of the ambulance cot while separated from the ambulance. This cot manipulation often requires that the patient supported on the litter be lifted to various elevated heights above the floor. In some instances, the weight factor can cause EMS personnel injury that requires medical treatment.

Accordingly, it is advantageous to provide vertically adjustable hand grips on the ambulance cot to orient the hand grips at the appropriate elevation to enable the attendant to more comfortably lift the cot with less stress on the back muscles.

SUMMARY OF THE INVENTION

An ambulance cot has a wheeled base and a patient litter. The patient litter includes a pair of hollow, laterally spaced, longitudinally extending side rails, the side rails being configured to extend from a head end to a foot end of the patient litter. At least one retractable, generally U-shaped litter section with at least one hand grip is oriented thereon adjacent a bight portion thereof. The legs of the U-shaped litter section are configured to be slidably received into the interior of the respective longitudinally extending side rails, each of the parallel legs having first and second sections and a hinge configuration interconnecting them. A locking mechanism is provided for releasably locking the first and second sections together so as to prevent relative movement therebetween them and for unlocking the connection so as to permit a relative movement about an axis of the hinge configuration so that when the U-shaped litter section is in an extended position and the latch mechanism is in an unlocked condition, the first and second sections will be moveable with respect to one another to orient the hand grip at a different elevation.

BRIEF DESCRIPTION OF THE DRAWINGS

Various objects and purposes of the invention will become apparent based upon a review of the following specification and upon a review of the several drawings.

DETAILED DESCRIPTION

Ambulance Cot

Figure 1:
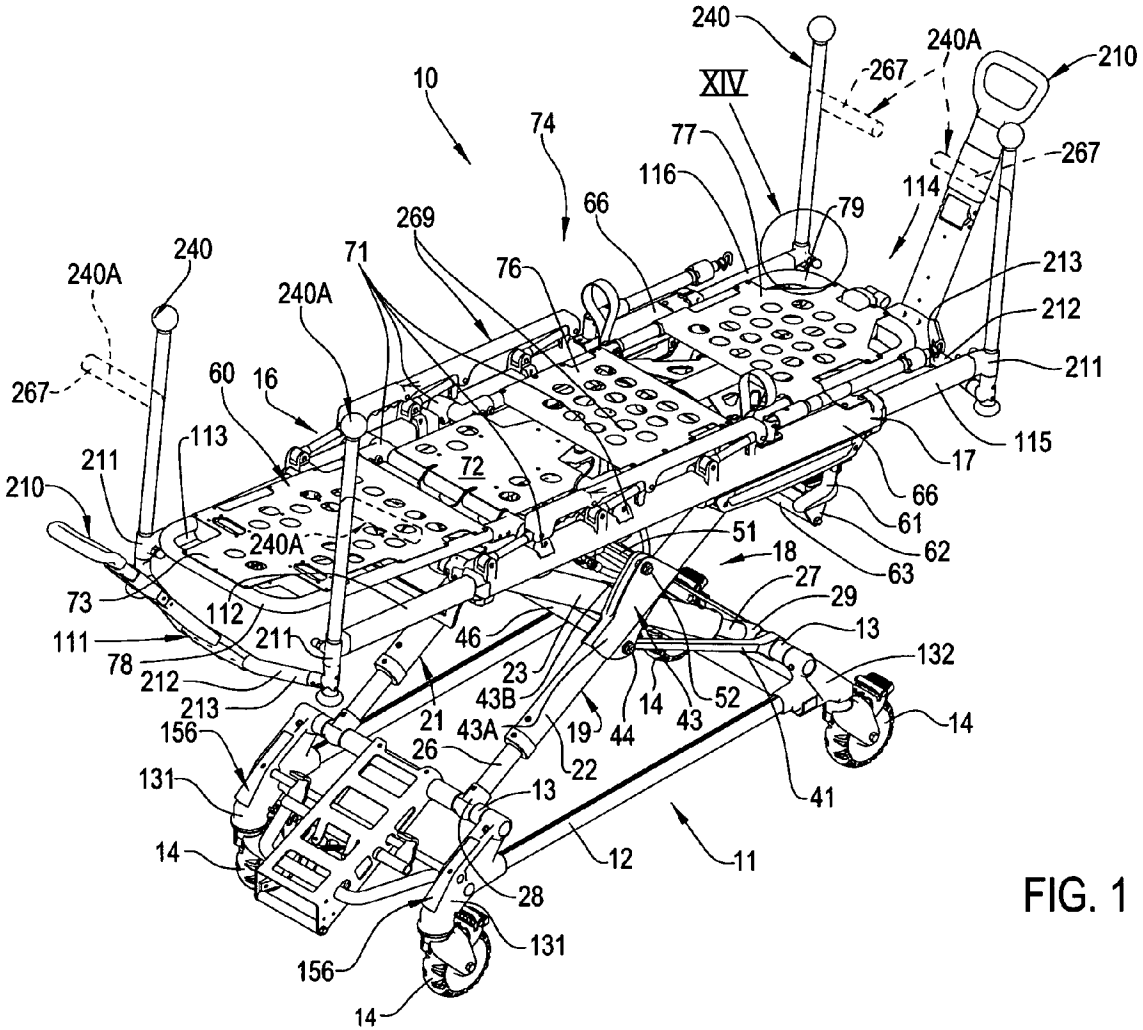
FIG. 1 is an isometric view of an ambulance cot embodying the invention, which ambulance cot is in the fully raised position.

An ambulance cot 10 embodying the invention is illustrated in the drawings. The ambulance cot 10 is similar to the ambulance cots disclosed in U.S. Pat. No. 5,537,700, and international patent application no. PCT/US05/034665, the subject matters thereof being incorporated herein by reference. The ambulance cot 10 includes a base frame 11 composed of longitudinally extending side rails 12 and crosswise extending rails 13 interconnected by brackets 131, 132 at the respective ends thereof to the side rails 12 to form a rectangle. Castered wheels 14 are operatively connected to each corner of the rectangle base frame 11 formed by the rails 12 and 13.

The ambulance cot 10 includes a litter 16 comprising a litter frame 17. An elevating mechanism 18 is provided between the base frame 11 and the litter frame 17 in order to facilitate a lifting and lowering of the litter 16 relative to the ground. More specifically, the elevating mechanism 18 includes a pair of side-by-side oriented "X" frames 19 and 21. The X frame 19 includes a pair of X frame members 22 and 23 connected together adjacent their mid-length portions by means of a pivot axle (not shown). Each of the X frame members 22 and 23 is hollow and telescopingly receives therein a further X frame member 26 and an X frame member 27, respectively. The further X frame members 26 and 27 are supported for movement into and out of the respective X frame members 22 and 23. The distal end of the further X frame member 26 is secured via a connection 28 to the cross rail 13 at the left end (foot end) of the base frame illustrated in FIG. 1 whereas the distal end of the further X frame member 27 is connected via a connection 29 to the cross rail 13 at the right end (head end) of the base frame 11.

The X frames 19 and 21 are similarly constructed. The X frame 21 includes a pair of X frame members 32 and 33 which are connected together at about their mid-length portions by the aforesaid axle (not shown) that connects the X frame members 22 and 23. Due to the aforesaid similarity of the construction of the X frames 19 and 21, further details of the X frame 21 is believed to be unnecessary. While the aforesaid axle can extend laterally between the X frames 19 and 21, it is to be understood that separate axles can, if desired, be employed and as explained below.

Figure 2:
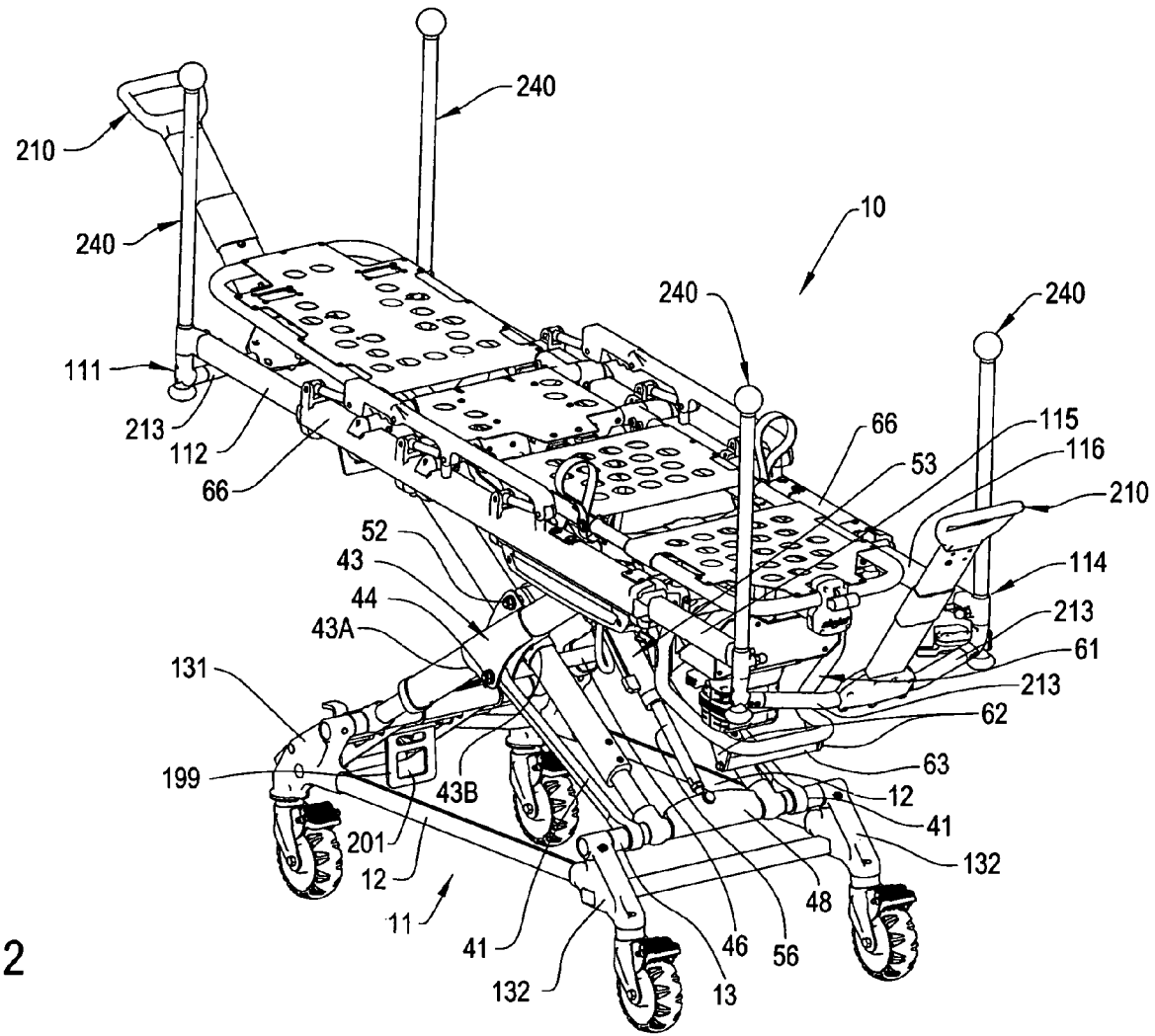
FIG. 2 is an isometric view of an ambulance cot similar to FIG. 1, except that the ambulance cot is viewed from the foot end.

Referring to FIG. 2, to the crosswise extending rail 13 there is pivotally connected a pair of laterally spaced, parallel extending, linkage members 41. In this particular embodiment, each of the linkage members 41 includes at the end thereof adjacent the cross rail 13 a bore which encircles the cross rail 13 to facilitate the pivotal connection of each of the linkages 41 about the longitudinal axis of the cross rail 13. The ends of each of the linkages 41 remote from the cross rail 13 are connected to respective laterally spaced brackets 43 by means of a fastener 44. In this particular embodiment, a pair of laterally spaced brackets 43 are provided and each bracket is composed of two parts 43A, 43B pivotally connected together and relatively movable about a horizontal axis. Each bracket part 43A and 43B is hollow. A sleeve 46 extends between the respective bracket parts 43A and receives therein the respective fastener 44 to facilitate the connection of the linkages 41 to the bracket parts 43A. Each of the bracket parts 43A and 43B includes a receptacle into which is received a respective X frame member 22, 23, 32 and 33 as illustrated in FIG. 1.

A first bracket 48 (FIG. 2) is fixedly secured to the foot end cross rail 13. A second bracket (not shown) is secured to a rod 51 that is connected to and extends between the respective bracket parts 43A. In this particular embodiment, the rod 51 is connected to each bracket part 43A by a respective fastener 52.

At least one linear actuator 53 (two, if desired to provide improved stability) is connected to and extends between the respective brackets. In this particular embodiment, the linear actuator 53 includes a hydraulic cylinder housing 54 fastened to the not illustrated bracket on the rod 51, which cylinder housing 54 includes a reciprocal rod 56 having a piston (not illustrated) at one end thereof located within the cylinder housing 54. The distal end of the reciprocal rod 56 is connected in a conventional manner by a universal-like joint to the bracket 48. That is, the universal joint allows pivotal movement about two orthogonally related axes. As will be evident from FIGS. 2 and 3, extension and retraction of the reciprocal rod 56 will facilitate movement of the bracket parts 43A and 43B about the axis of the rod 46. The end of the rod 56 is lengthwise adjustable to accommodate tolerances encountered during production.

Figure 3:
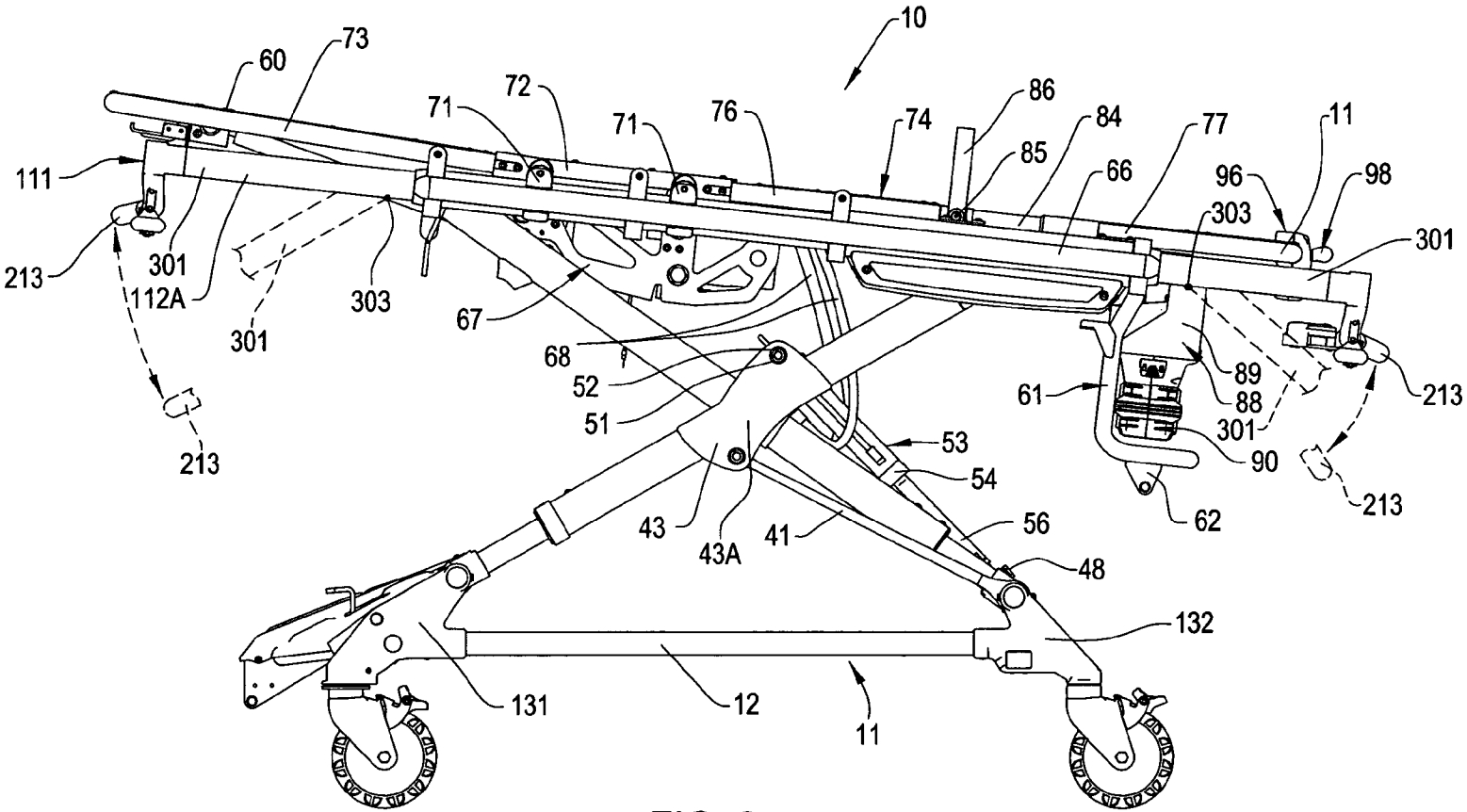
FIG. 3 is a side elevational view of the ambulance cot embodying the invention.

An electrical motor and hydraulic pump assembly 67 is mounted to the underside of the litter as shown in FIG. 3. An output shaft of the electrical motor is connected to and rotatably drives the input shaft of the hydraulic pump. Hydraulic fluid conduits 68 are provided for operatively connecting the inlet and outlet of the pump to the cylinder housing 54.

As is shown in FIG. 1, the litter 16 comprises a litter frame 17 which consists of a pair of lengthwise extending side rails 66 that are laterally spaced from one another, which side rails 66 are connected at the head end by a not illustrated cross rails. In this particular embodiment, the longitudinally extending side rails 66 of the litter frame 17 are hollow. Thus, the cross rails not specifically described are secured by brackets to the exterior surface of each of the side rails 66. Several of the brackets 71 are illustrated in FIG. 1.

A battery mount 88 is secured to the underside of the litter frame 16 adjacent the foot end thereof by a bracket 89. The battery mount 88 includes a downwardly opening bayonet socket configured for the reception of a battery 90. A first, generally upright U-shaped latch frame 61 is also secured to the underside of the litter frame adjacent the battery supporting bracket 89. The bight section 64 of the U-shaped latch frame 61 has on the bottom side thereof a pair of downwardly extending and laterally spaced brackets 62 to which is connected and extending therebetween a latch bar 63.

The litter frame 17 has mounted thereon a patient support deck 60 which is composed of a seat section 72, a head section or fowler 73 and a foot section 74. The seat section 72 is fixed to a pair of longitudinally spaced cross bars that extend laterally between the corresponding brackets 71 on the side rails 66. The foot section 74 is composed of a thigh section 76 and a calf section 77. The frame 78 for the head section 73 is pivotally mounted to the cross bar to which the head end of the seat section 72 is secured. Furthermore, the frame 79 of the foot section 74 is pivotally mounted to the cross bar to which the foot end of the seat section 72 is secured.

Figure 4:
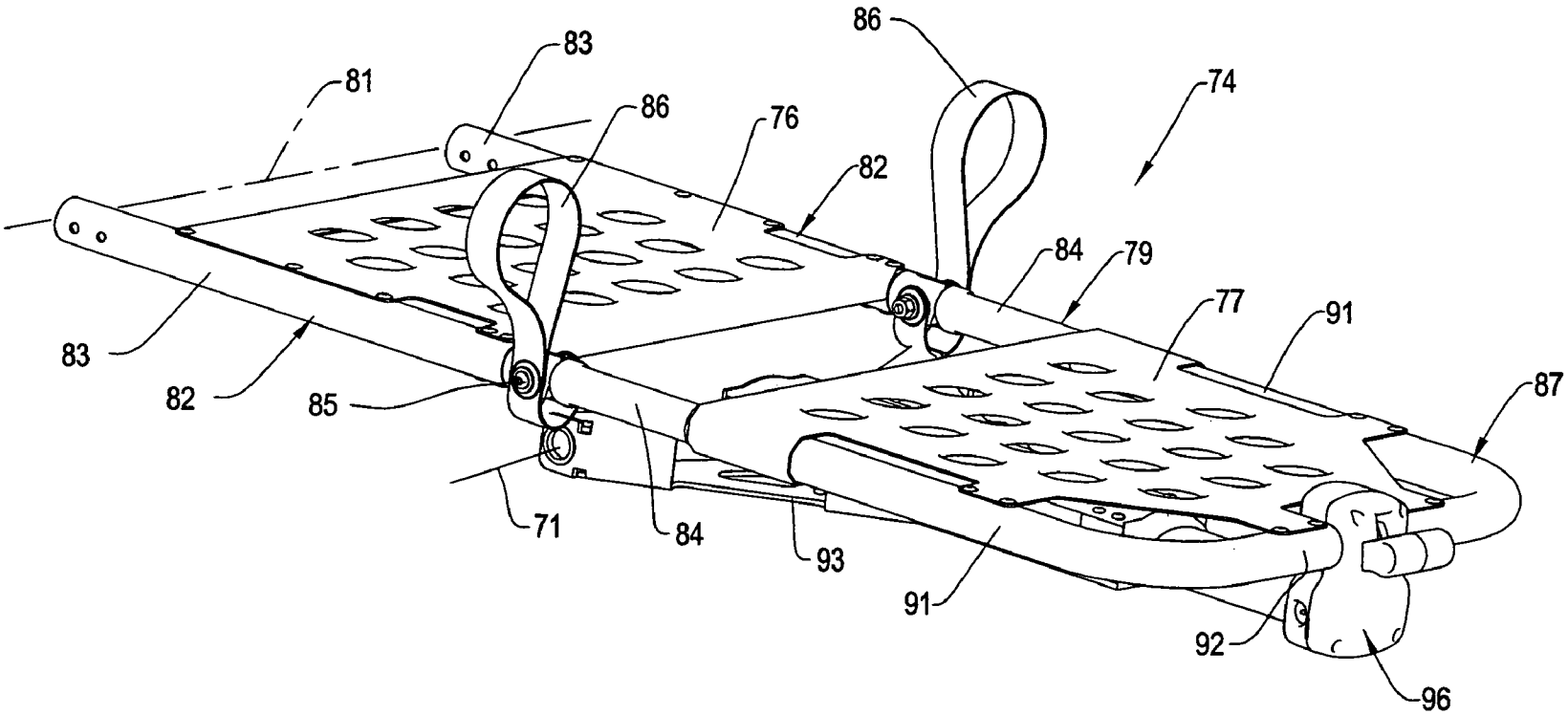
FIG. 4 is an isometric view of the foot section portion of the patient support deck.

In FIG. 4, the foot section 74 has been isolated from the ambulance cot 10. The foot section 74 is, as has been stated above, pivotal with respect to the seat section 72 about an axis 81 of the crossbar located at the foot end of the seat section 72. The frame 79 of the foot section 74 is generally U-shaped. The distal end of the legs 82 of the U-shaped frame are secured to a bracket (not illustrated) which facilitates the pivotal securement of the legs 82 for movement about the axis 81, as aforesaid. Each of the legs 82 is comprised of multiple components. More specifically, each leg 82 is composed of a leg segment 83 attached to brackets for facilitating a pivotal support thereof about the axis 81, as aforesaid. Leg segments 84 are pivotally connected to the aforesaid leg segments 83 by a bracket 80 (FIG. 10) and fasteners 85. Flexible straps 86 forming loop-like handles are secured by the fasteners 85 to the ends of the leg segments 83 remote from the axis 81. The foot end of the foot section 74 constitutes the aforesaid calf section 77. The frame 87 of the calf section 77 is U shaped and has parallel legs 91 interconnected at the foot end by a bight section 92. The legs 91 are hollow and telescopingly receive therein the leg segments 84. Thus, the frame 87 is movable toward and away from the loop-like handles 86.

Figure 5:
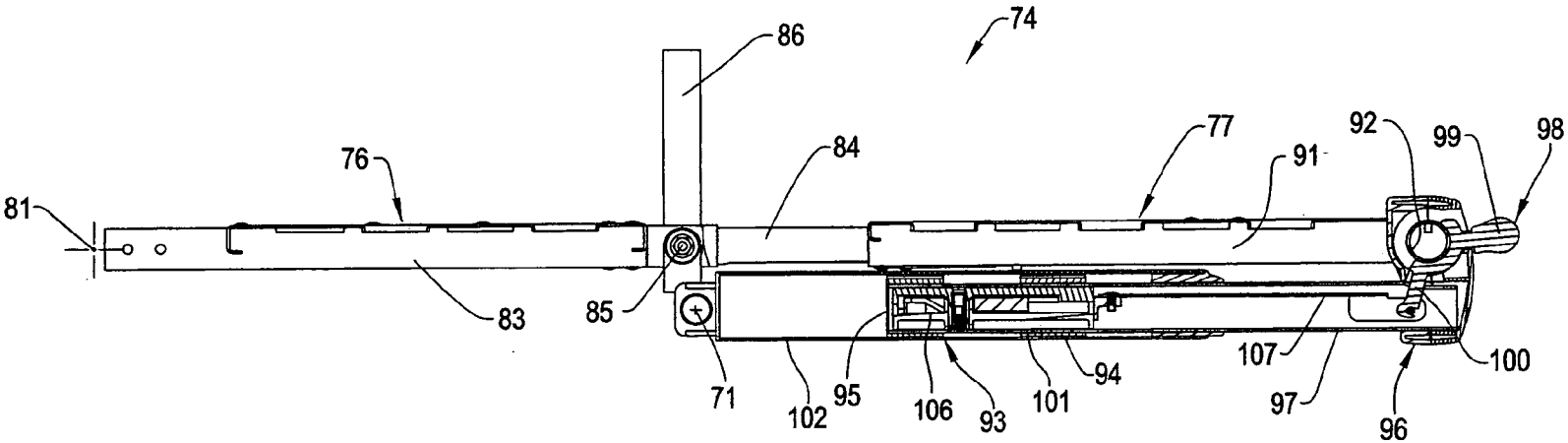
FIG. 5 is a partially sectioned side view of the foot section portion of the patient support deck.

Referring to FIGS. 4 and 5, to one of the crossbars connected to one of the brackets 71 on the litter frame 17 is pivotally secured an extendable and retractable bracket 93. More specifically, the extendable and retractable bracket 93 includes a hollow housing member 94 pivotally secured to the crosswise member attached to one of the aforesaid brackets 71 on the side rails 66. A slide member 95 is slidably received inside the housing member 94. The slide member 95 includes an extension 97 extending toward the foot end of the ambulance cot 10 and terminating in a bracket 96 that facilitates a connection of the foot end of the frame 87 to the foot end of the extension 97. As is illustrated in FIG. 4, the bracket 96 encircles the bight section 92 of the frame 87. A handle member 98 is provided on the bracket 96 and is supported for movement about an axis of the bight section 92 between first and second positions. The handle is actually a two-arm lever arm, one arm 99 forming the aforesaid handle and the other arm 100 being on the opposite side of the axis of the bight section 92.

Figure 6:
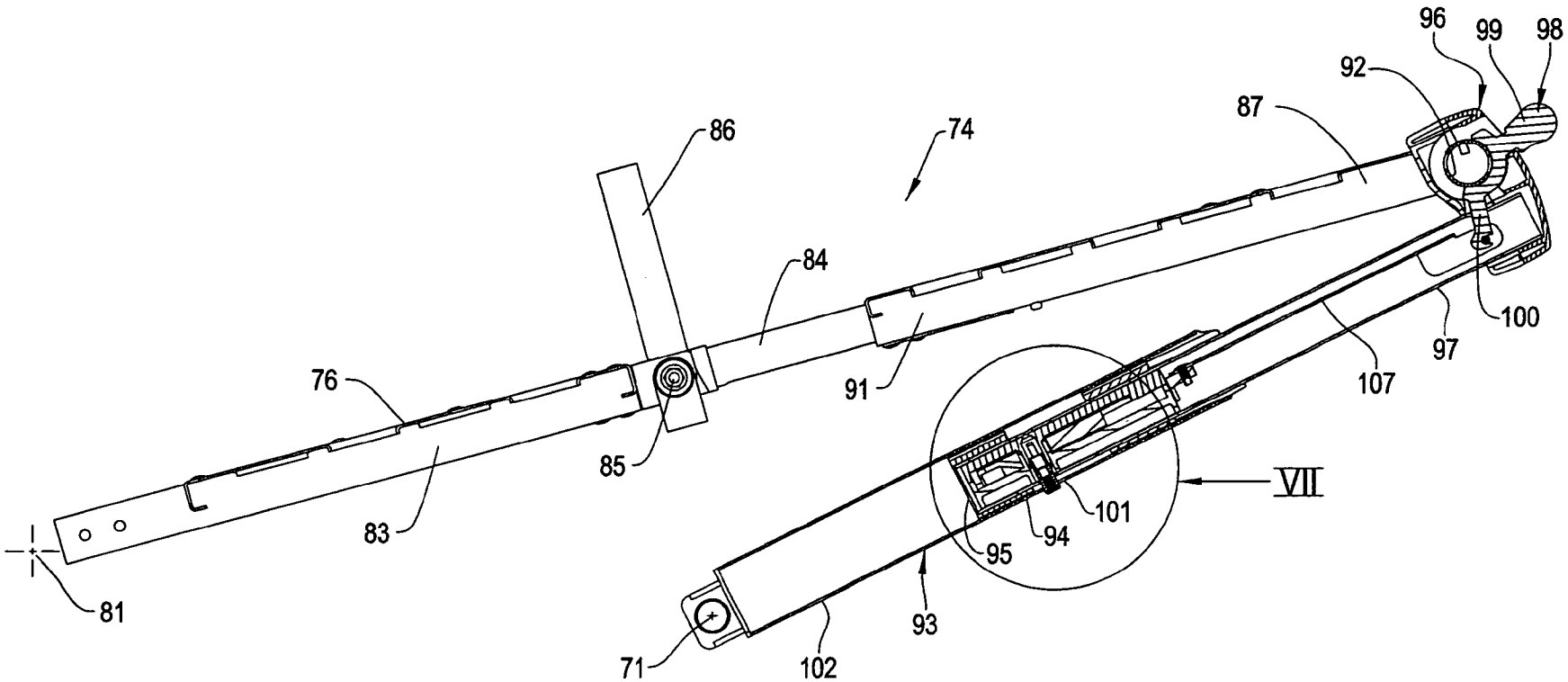
FIG. 6 is a partially sectioned side view of the foot section portion of the patient support deck raised to the Trendelenberg position.
Figure 7:
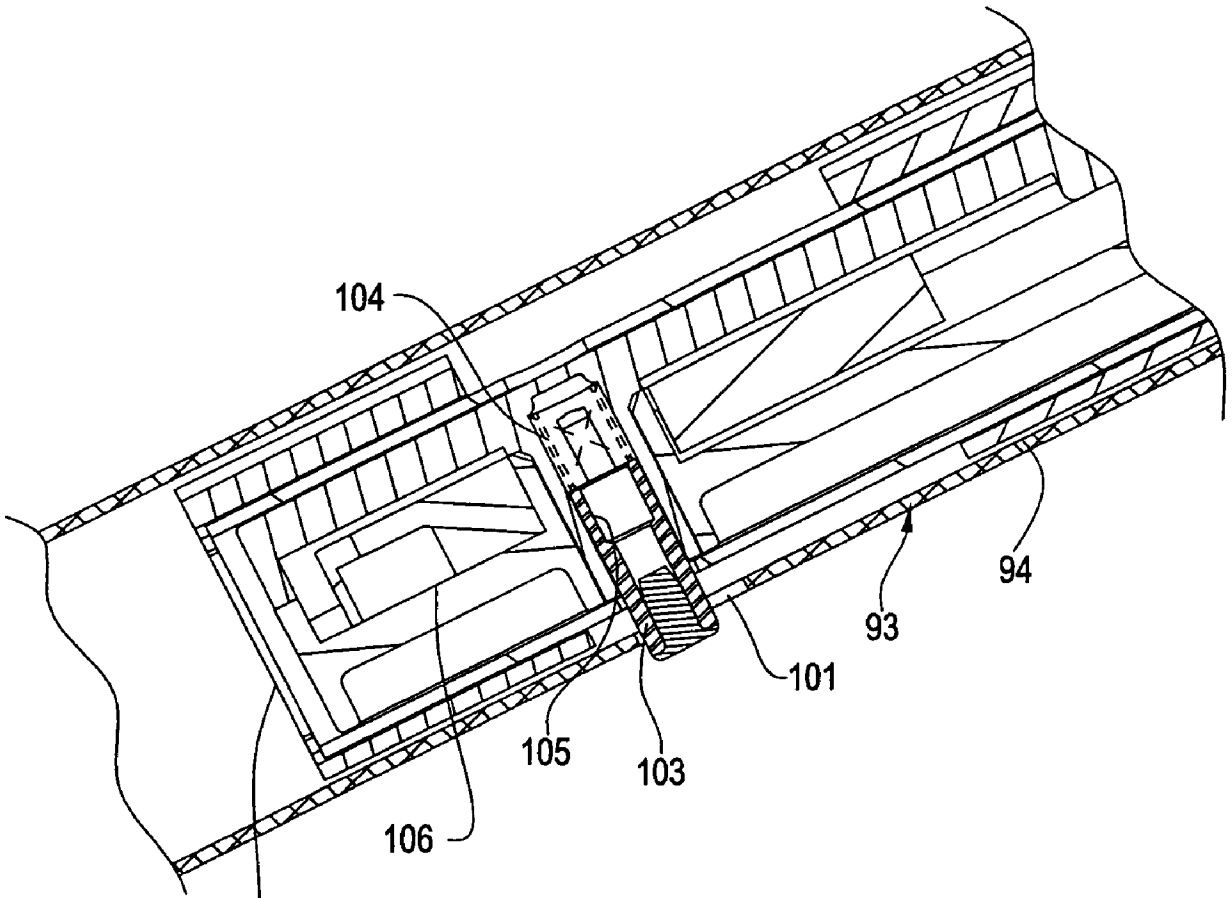
FIG. 7 is an enlarged fragment of the encircled part VII of FIG. 6.

The housing member 94 has two longitudinally spaced holes 101 and 102 therein. The slide member 95 includes a pin 103 that is continually resiliently urged by a spring 104 to a fully extended position, such as is illustrated in FIGS. 6 and 7. The pin 103 is mounted in a bore 105 provided on the slide member 95, the axis of the bore 105 extending generally perpendicular to the longitudinal axis of the hollow housing member 94. The slide member 95 also includes a reciprocal shuttle 106 mounted therein and connected by a linkage 107 to the arm 100 of the handle 98. The shuttle 106 operatively connects to the pin 103 to effect a retraction of the pin to the position illustrated in FIG. 5 when the arm 99 of the handle 98 is moved upwardly (counterclockwise) from the position illustrated in FIG. 5. Retraction of the pin 103 will enable the slide member to move lengthwise of the housing 94.

FIG. 5 illustrates the position of the foot section 74 in a flat condition generally corresponding to that illustrated in FIGS. 1, 2 and 3. When a manual force applied to the foot end of the foot section, namely to the bight section 92 and/or the bracket 96 to effect a lifting thereof, the foot section 74 will transition from the FIG. 5 position to the FIG. 6 position at which time the pin 103 will become aligned with the hole 101 and the spring 104 will urge the pin into the hole 101 as illustrated more clearly in FIG. 7. This position of the foot section 74 corresponds to the Trendelenberg position of the patient support deck. When it is desired to return the foot section 74 to the original position illustrated in FIG. 5, an attendant need only move the handle 98 upwardly (counterclockwise) from the position illustrated in FIG. 6 to cause the arm 100 to pull on the linkage 107 to draw the shuttle 106 toward the foot end and effect a lifting of the pin 103 out of the hole 101 against the urging of the spring 104. The cam structure for effecting a lifting of the pin 103 is not disclosed in any detail herein but is essentially the same type of mechanism as is utilized for controlling the pin 127 as discussed below.

Figure 8:
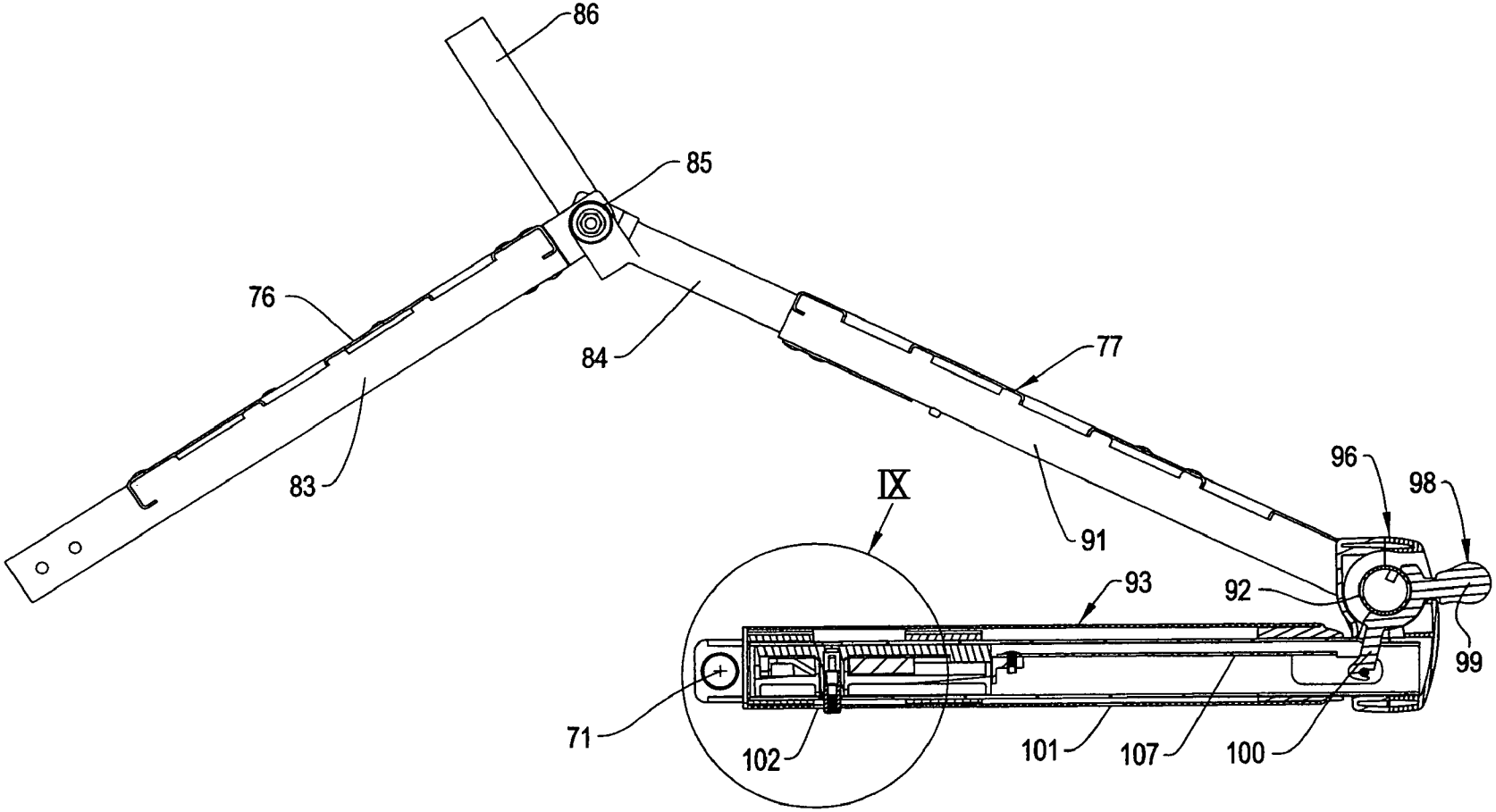
FIG. 8 is a partially sectioned side view of the foot section portion of the patient support deck oriented into the gatch configuration.
Figure 9:
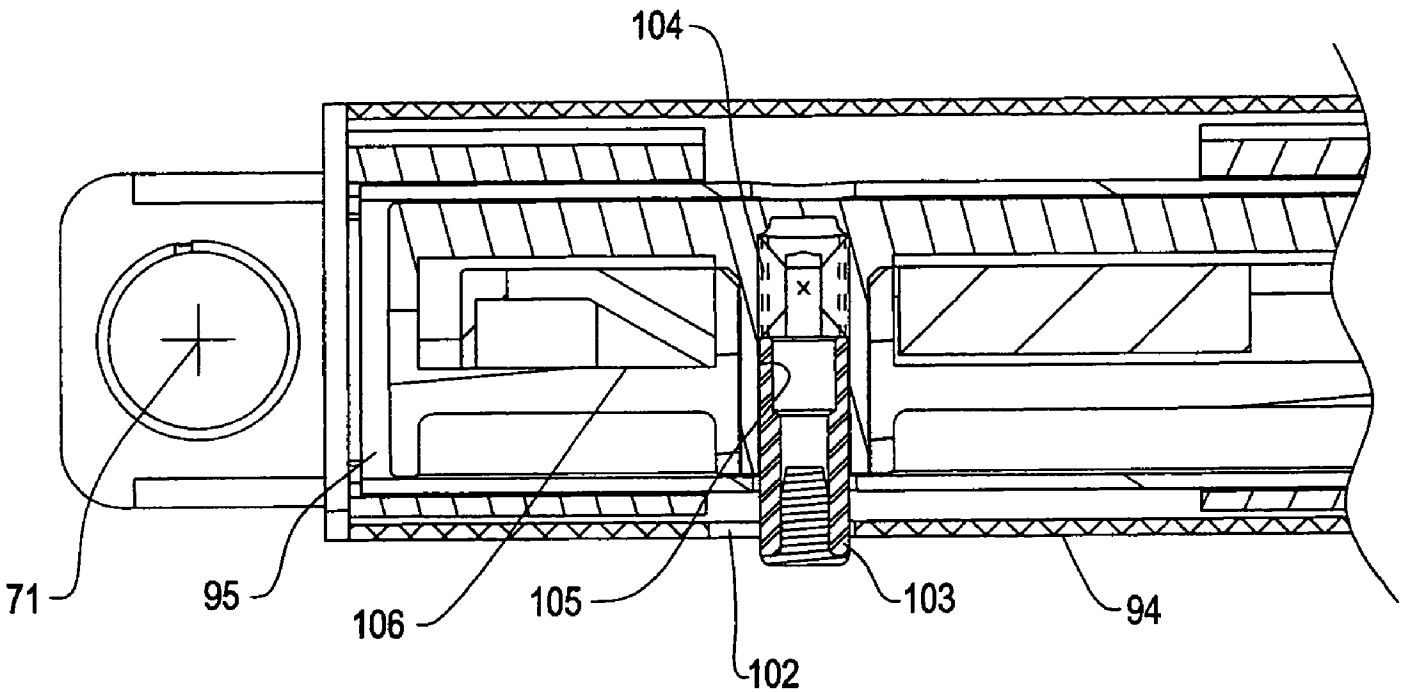
FIG. 9 is an enlarged fragment of the encircled part IX of FIG. 8.

When it is desired to convert the foot section from the position illustrated in FIG. 5 to the position illustrated in FIG. 8, an attendant need only lift upwardly on the loop-like handle 86 and, in doing so, will cause the foot end of the calf section 77 to urge the extension 97 leftwardly in FIG. 5 so that the slide member 95 will move to the position illustrated in FIG. 8, namely, a position adjacent the crossbar connected to the brackets 71 on the side rails 66. In this location, the bore 105 for the pin 103 will become aligned with the hole 102 to enable the spring 104 to urge the pin from its retracted position to its fully extended position as illustrated in FIG. 9. When the pin is oriented in the position illustrated in FIGS. 8 and 9, the thigh section 76 and the calf section 77 forming an inverted V-shape will be locked in that position due to the inability of the slide member 95 being able to move due to the pin 103 being received into the hole 102.

Figure 10:
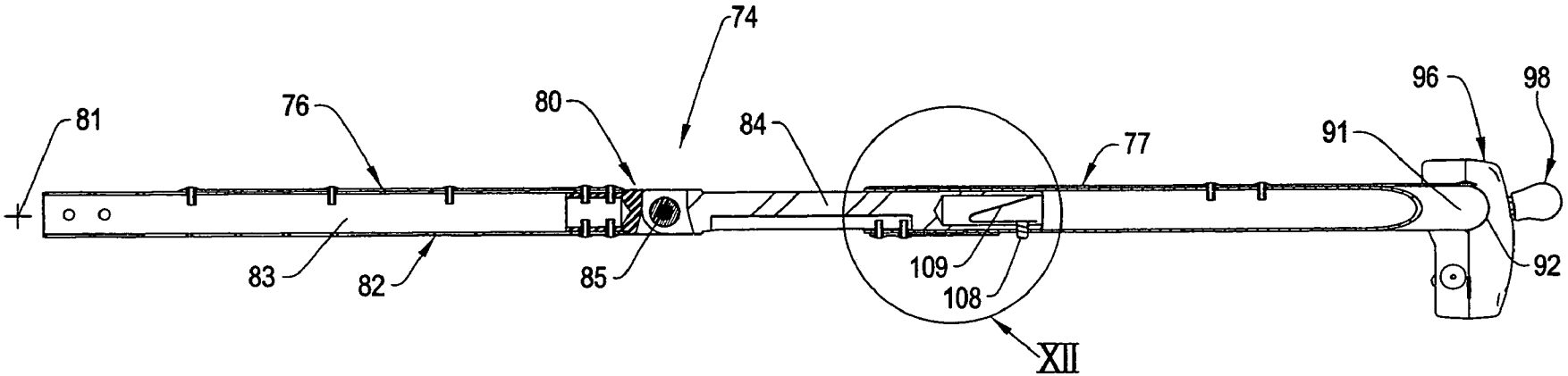
FIG. 10 is a partially sectioned side view of the foot section portion of the patient support deck in an extended position.
Figure 11:
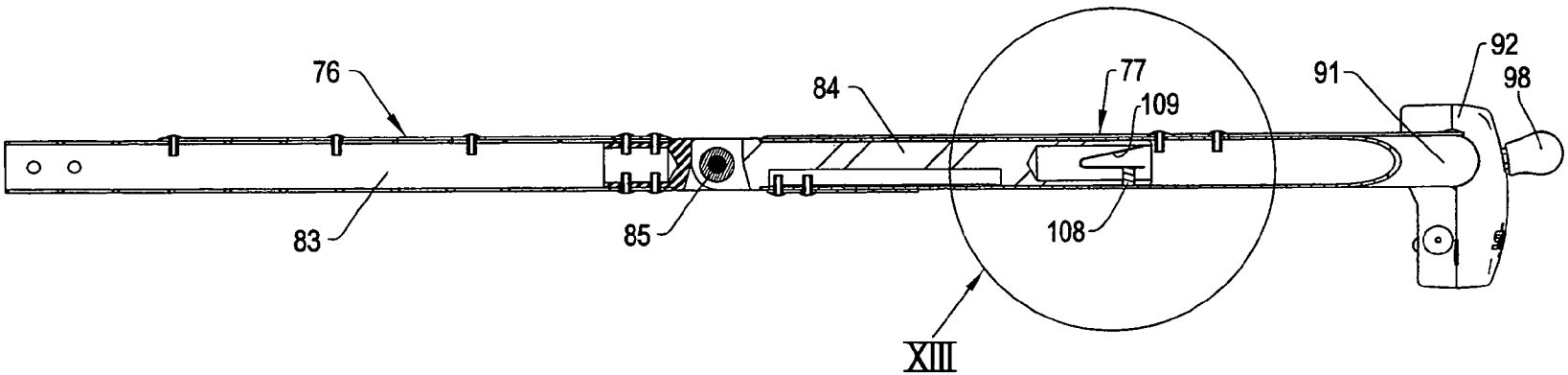
FIG. 11 is a partially sectioned side view of the foot section portion of the patient support deck in a retracted position.
Figure 12:
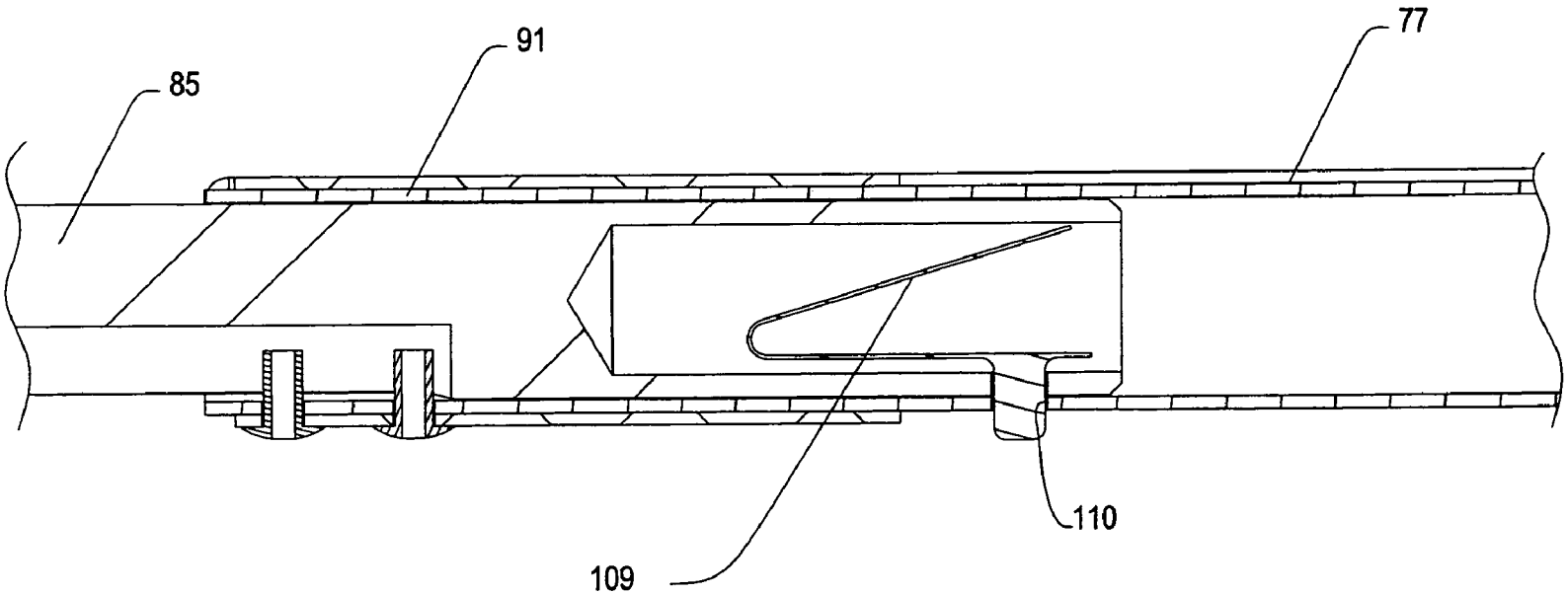
FIG. 12 is an enlarged fragment of the encircled part XII of FIG. 10.
Figure 13:
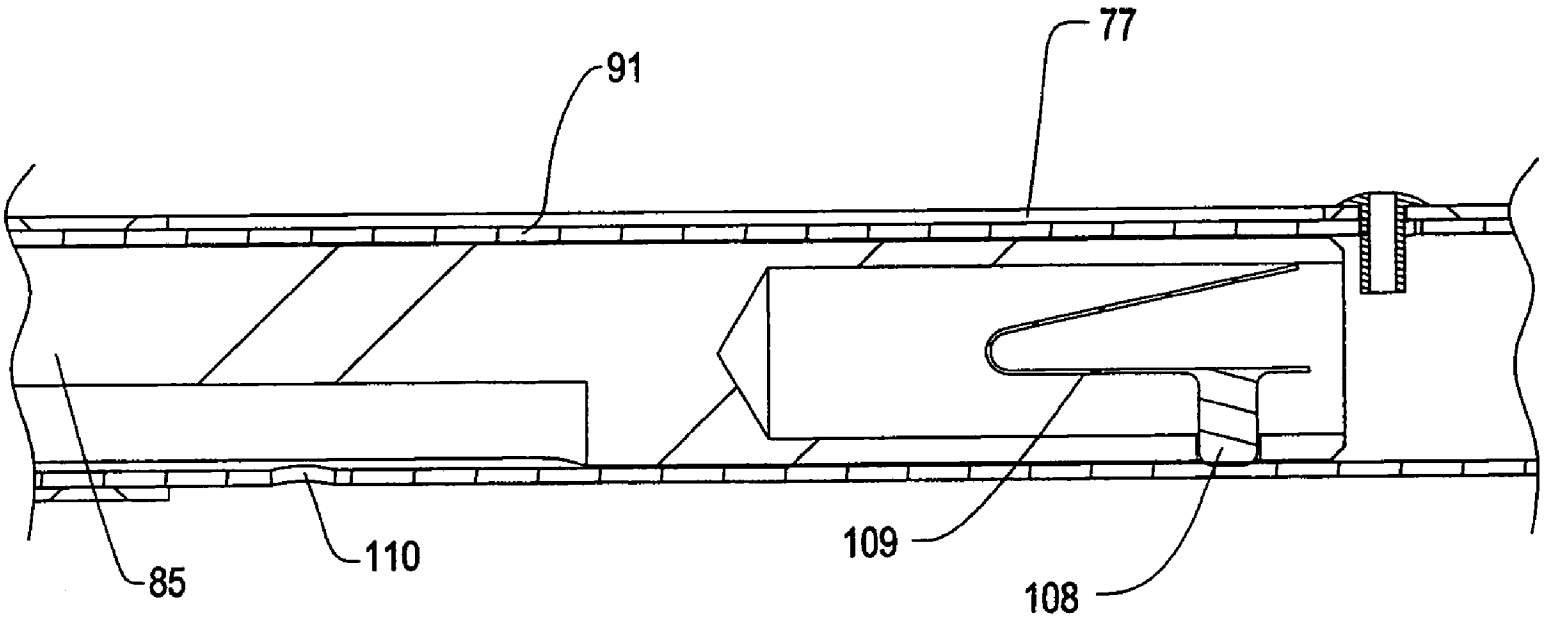
FIG. 13 is an enlarged fragment of the encircled part XIII of FIG. 11.

As stated above, the calf section 77 is capable of moving toward and away from the thigh section 76. As illustrated in FIG. 10, the thigh section 77 has been moved away from the thigh section 76. The end of the leg segment 84 remote from the fasteners 85 include a pin 108 urged by a spring 109 into a hole 110 (FIG. 12) provided in the leg segment 91. From time-to-time, it is desired to shorten the length of the foot section 74 by moving the calf section 77 toward the thigh section 76, namely to a position illustrated in FIG. 11. In order to accomplish this task, the attendant need only to find the distal end of each of the pins 108 and urge them upwardly into the respective holes 110 against the urging of the spring 109 so that force can be applied to the foot end of the frame 87 and urge it from the position illustrated in FIG. 10 to the position illustrated in FIG. 11. The distal end of the pins 108 slide on the interior surface of the legs 91 as shown in FIG. 13. During this movement, the extendable and retractable bracket 93 retracts but not far enough to cause the pin 103 to enter into the hole 102.

Retractable Head and Foot Sections and Latches Therefor

Figure 17:
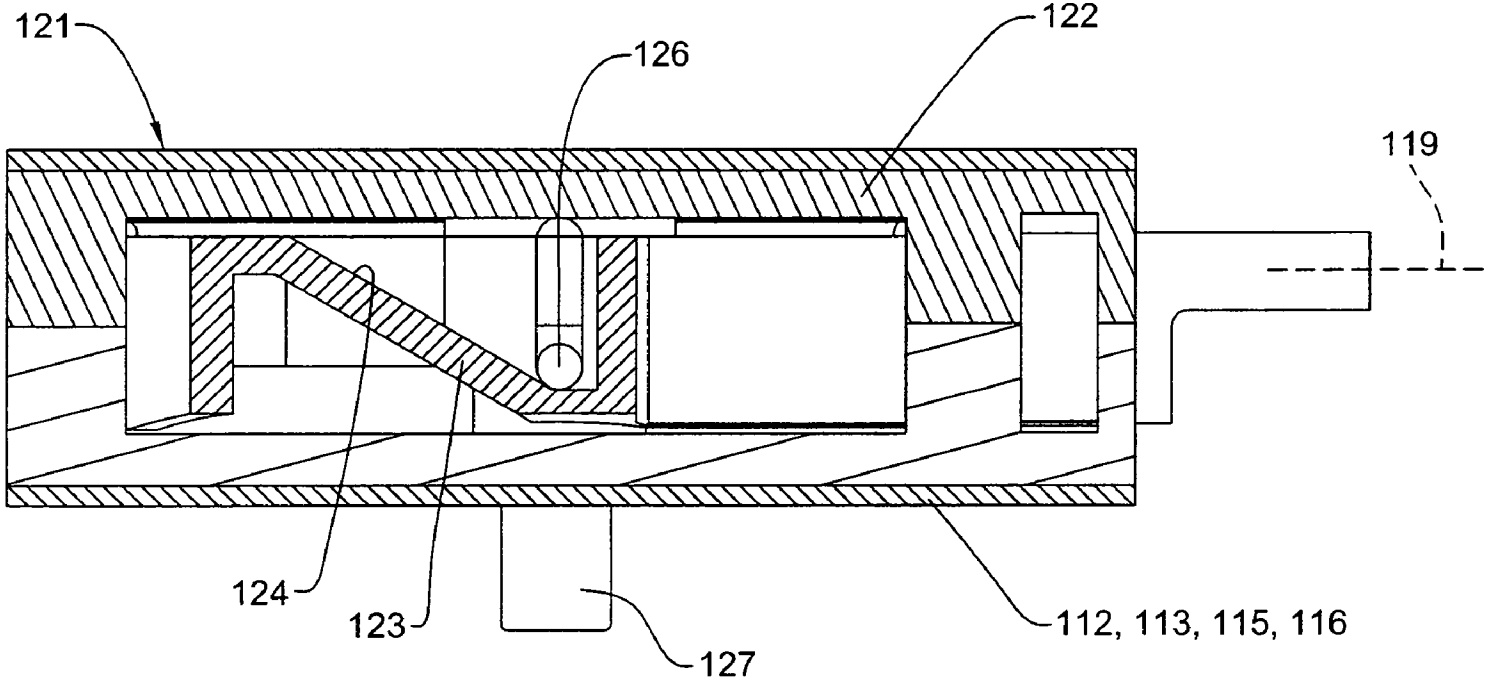
FIG. 17 is an enlarged sectional view through the latch mechanism illustrated in FIG. 15.
Figure 18:
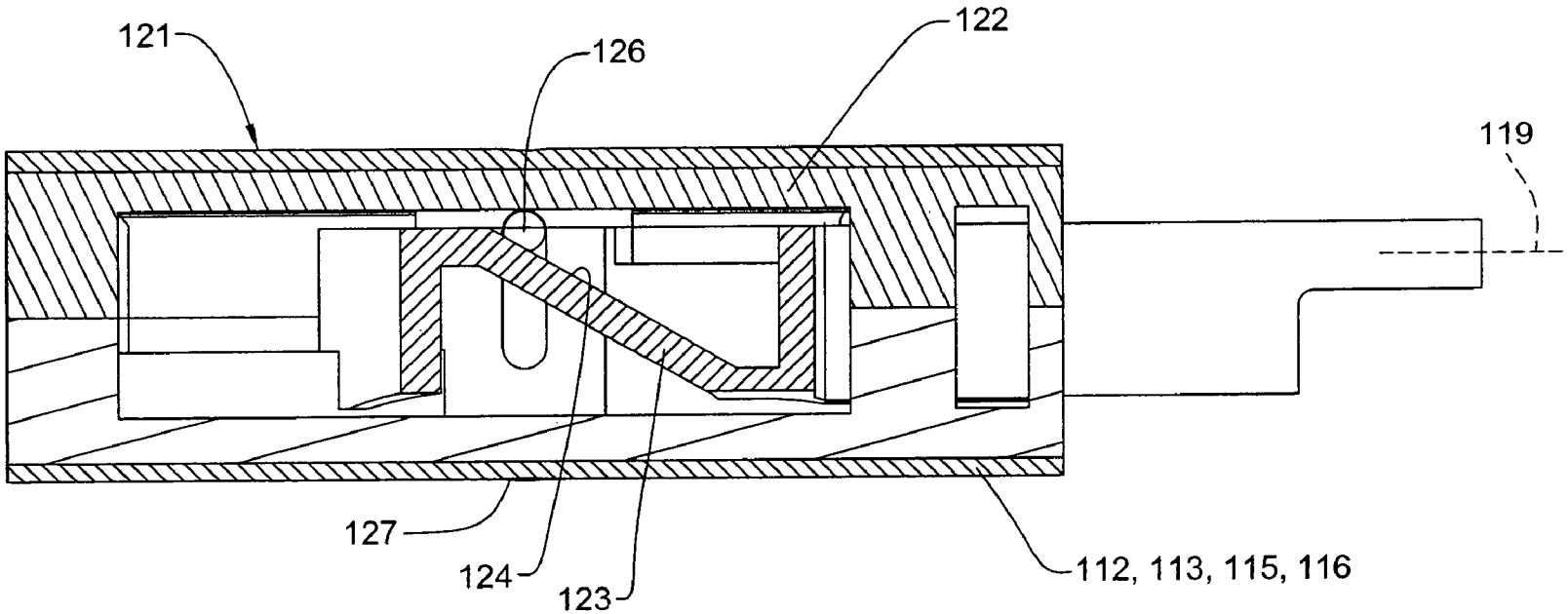
FIG. 18 is a sectional view similar to FIG. 17, except that the latch mechanism has been shifted to the position illustrated in FIG. 16.

As stated above, the side rails 66 of the litter frame 17 are hollow. A generally U-shaped retractable litter frame head section 111 has legs 112 and 113 received into the interior of the side rails 66 at the head end thereof while a generally U-shaped retractable litter frame foot section 114 has legs 115 and 116 received into the interior of the side rails 66 at the foot end thereof. This feature can be provided on a manual lift cot or a power lift cot. The legs 112 and 113 and the legs 115 and 116 are configured to be slidably received by, into the interior of (shown), next to, or below the respective longitudinally extending side rails 66 on the cot 10. The legs 112, 113, 115 and 116 are each hollow and include an elongate slot 117 (FIG. 14) therein for facilitating the sliding movement of a pin 118 between the solid line position and broken line position or the positions shown in FIGS. 15 and 16. The pin 118 is connected by a linkage 119 to a latch mechanism 121 on each leg 112, 113, 115 and 116. The latch mechanism 121 is illustrated in more detail in FIGS. 17 and 18. More specifically, the latch mechanism 121 includes a housing 122 in which a ramp mechanism 123 is slidably disposed lengthwise of the housing 122. The ramp mechanism 123 includes a ramp surface 124 against which a pin 126 rests. The pin 126 includes a latch pin 127 that is configured to move laterally into and out of the housing 122. The position located outside the housing is illustrated in FIG. 17. A spring (not illustrated) urges the pin 126 against the ramp surface 124. When the pin 118 is manually pulled toward the respective head end and foot end of the cot, the pin 118 is moved from the position illustrated in FIG. 15 to the position illustrated in FIG. 16 to cause a leftward movement of the linkage 119 in each leg 112, 113, 115 and 116 to cause each pin 126 to shift in its position illustrated in FIG. 17 to the position illustrated in FIG. 18, namely, a position wherein the latch pin 127 has been retracted laterally into the housing 122 of the latch mechanism 121. A slot 128 (FIG. 16) in the link 119 is provided which allows independent, passive engagement of the latch pins 127 when the pins 118 are released. A plurality of holes 129 are provided along the length of the side rails 66 and are configured to receive therein the latch pin 127 when in the extended position thereof as shown in FIG. 17. These holes are located such that access to them is not possible, i.e., under a bumper provided on the exterior of the litter rail 66. This is done for protection against inadvertent release, foreign matter, or potential pinching point. When the latch pin is received in an associated hole 129 provided in the side rail 66, the retractable head and foot sections 111 and 114 will be physically locked to the cot in either the retracted position or the extended position.

FIGS. 47-50 illustrate a modification of the construction of the legs 112, 113, 115 and 116 of the retractable head and foot head sections 111 and 114. In this particular embodiment, each of the modified legs will be referenced by the same reference number as was used in the preceding description but will have the suffix "A" added thereto.

In FIGS. 47-50, the linkage 119 has been replaced by a flexible cable 300 that interconnects the pin 118 to the latch mechanism 121. In addition, each of the legs 112A, 113A, 115A and 116A has two separate hollow leg sections 301 and 302 connected together end to end by a hinge configuration 303. The leg sections 301 and 302 are prevented from pivoting relative to one another by a latch mechanism 304 oriented adjacent to and on the inside of the end to end leg sections. The latch mechanism 304 includes an elongate latch member 306 pivotally supported at a mid-length location on a pin configuration 307 extending on an axis that is oriented generally perpendicular to the longitudinal axis of the leg section 301. If desired, the pin configuration 307 includes a pair of axially spaced, coaxial pins formed on the inside surface of the leg section 301, which pins are each received into opposite ends of the hole 310 in the latch member 306. In the alternative, the pin configuration 307 includes a single pin received into the hole 310 and is anchored at opposite ends to the wall of the leg section 301. The latch member 306 includes at one end a flange 308 extending generally at a right angle to the longitudinal axis of the latch member 306 and is configured to engage a radially inwardly extending wall segment 305 provided on the leg section 302 on a side thereof remote from the hinge configuration 303 to prevent the aforesaid relative pivoting movement between the leg sections 301 and 302. A yieldable flat leaf spring 309 is secured by a rivet 311 to the end of the latch member 306 remote from the flange and extends away from the latch member 306 to a location slidingly engaging the inside wall surface 312 of the leg section 301. The leaf spring 309 provides a continual spring force urging the latch member 306 counterclockwise in FIGS. 47-50. To facilitate the ability of the end of the leaf spring 309 sliding along the surface 312, the end 313 thereof remote from the end attached to the latch member 306 is bent to form a skid to facilitate the sliding engagement with the inside surface 312 of the leg section 301.

The latch member 306 has a pair of laterally spaced legs 316 (only one leg being shown in FIGS. 47-50) extending outwardly from the body of the latch member at a mid-length location. The spacing between the legs 316 is just larger in diameter than the diameter of the cable 300. The cable 300 is received between the spaced legs 316. A shaft 317 is secured to and extends between the legs 316 and rotatably supports a roller 318 thereon. The cable 300 is guided by the roller 318. An enlargement 319 is provided on the cable 300 and has a size larger than the spacing between the legs 316. In this particular embodiment, the enlargement 319 is integrally formed on the cable 300.

When the leg sections 301 and 302 are oriented inside the side rails 66 of the litter frame 17 at the time that the litter frame head section 111 and foot section 114 are in the retracted position, the leg sections will be unable to pivot relative to each other about the hinge configuration due to the leg sections being restricted from moving relative to one another by the walls of the side rails 66. While the latch mechanism 304 is at this time in the latching position, it does not serve to prevent the relative movement between the leg sections 301 and 302 when the head and foot sections 111 and 114 are in the retracted position.

Figure 15:
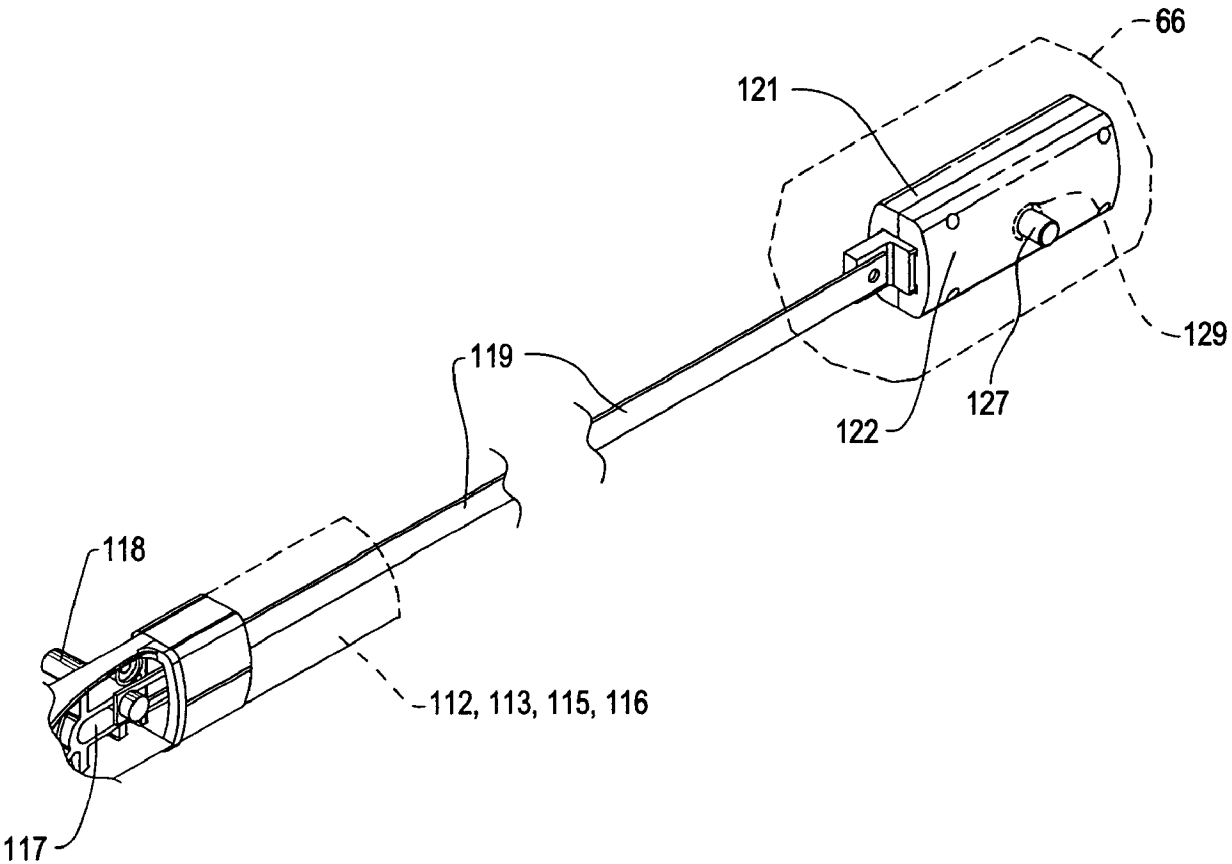
FIG. 15 is an isometric view of a latch system for an extendable and retractable head section and foot section of the litter frame.
Figure 16:
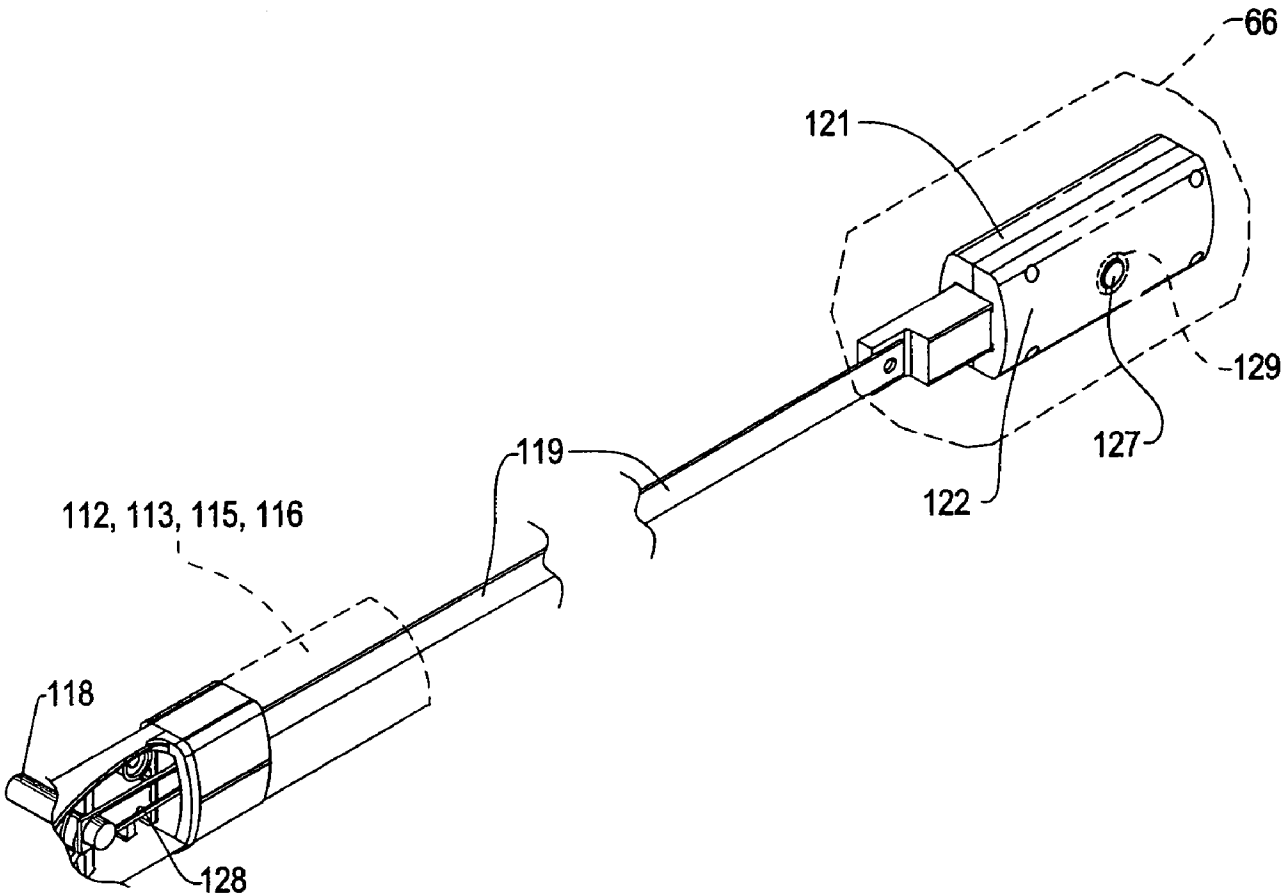
FIG. 16 is an isometric view similar to FIG. 15, except that the latch mechanism has been changed from a latched condition to an unlatched condition.
Figure 48:
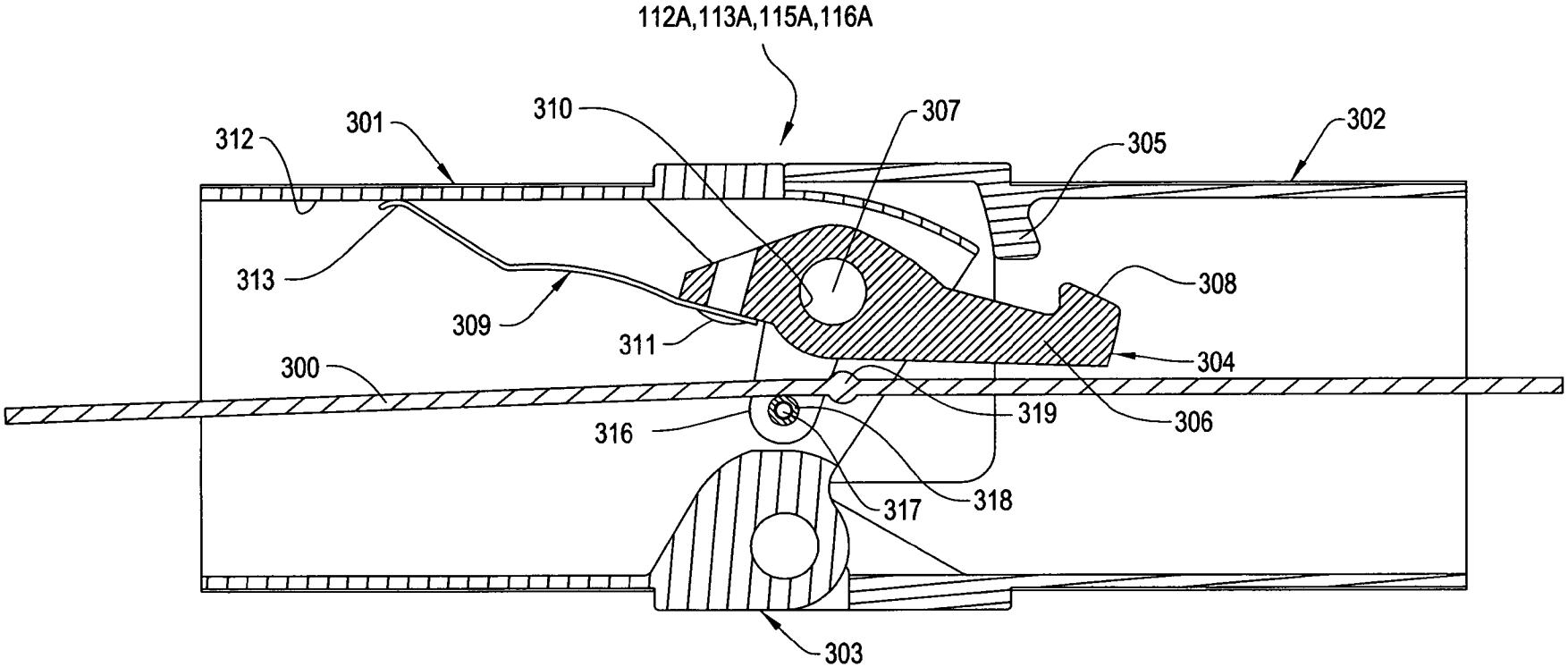
FIG. 48 is a fragmentary view similar to FIG. 55 but illustrating a latch member whose position has been moved.
Figure 49:
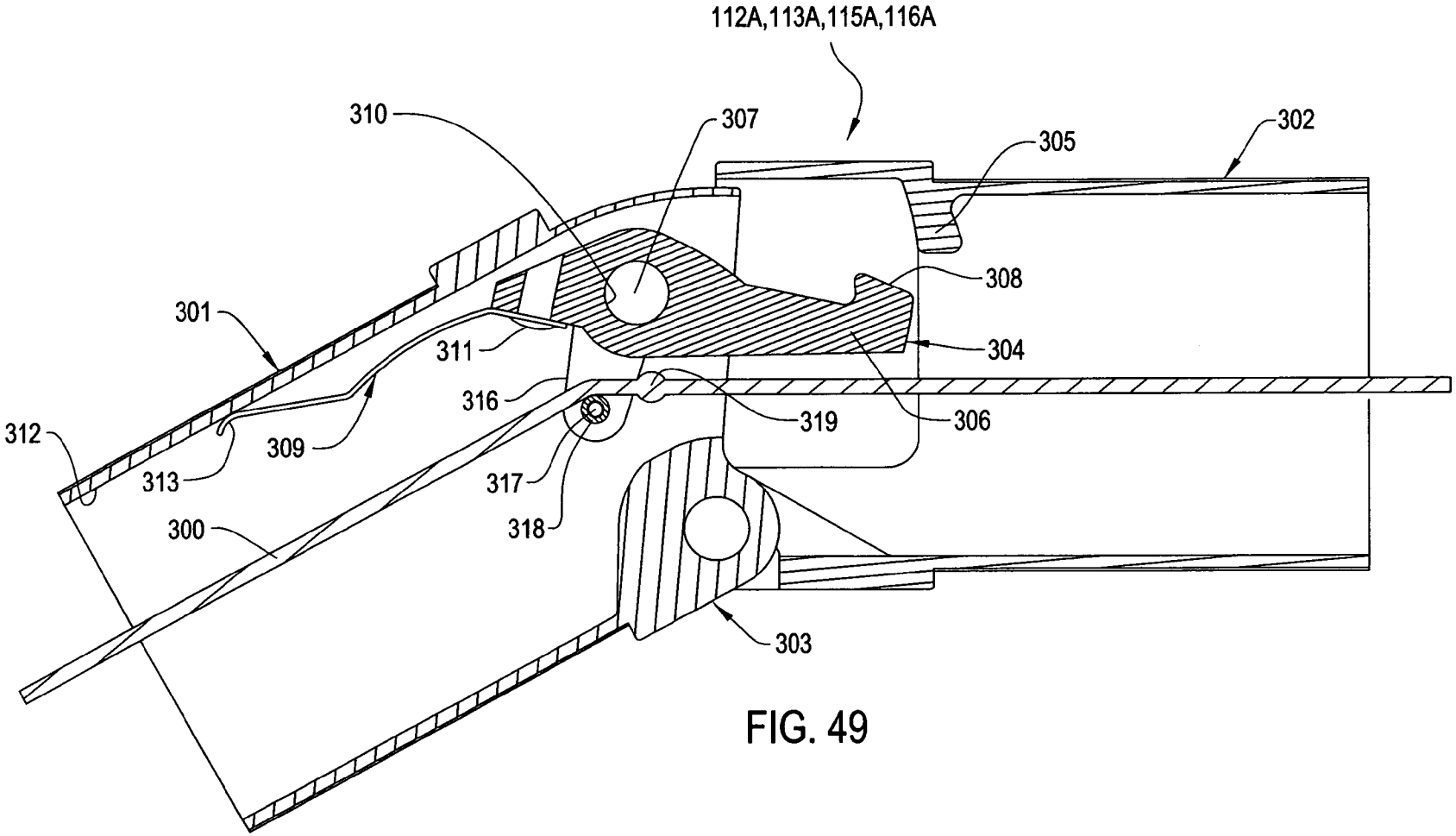
FIG. 49 is a fragmentary view similar to FIG. 56 but illustration one leg section being pivoted relative to the other leg section.
Figure 50:
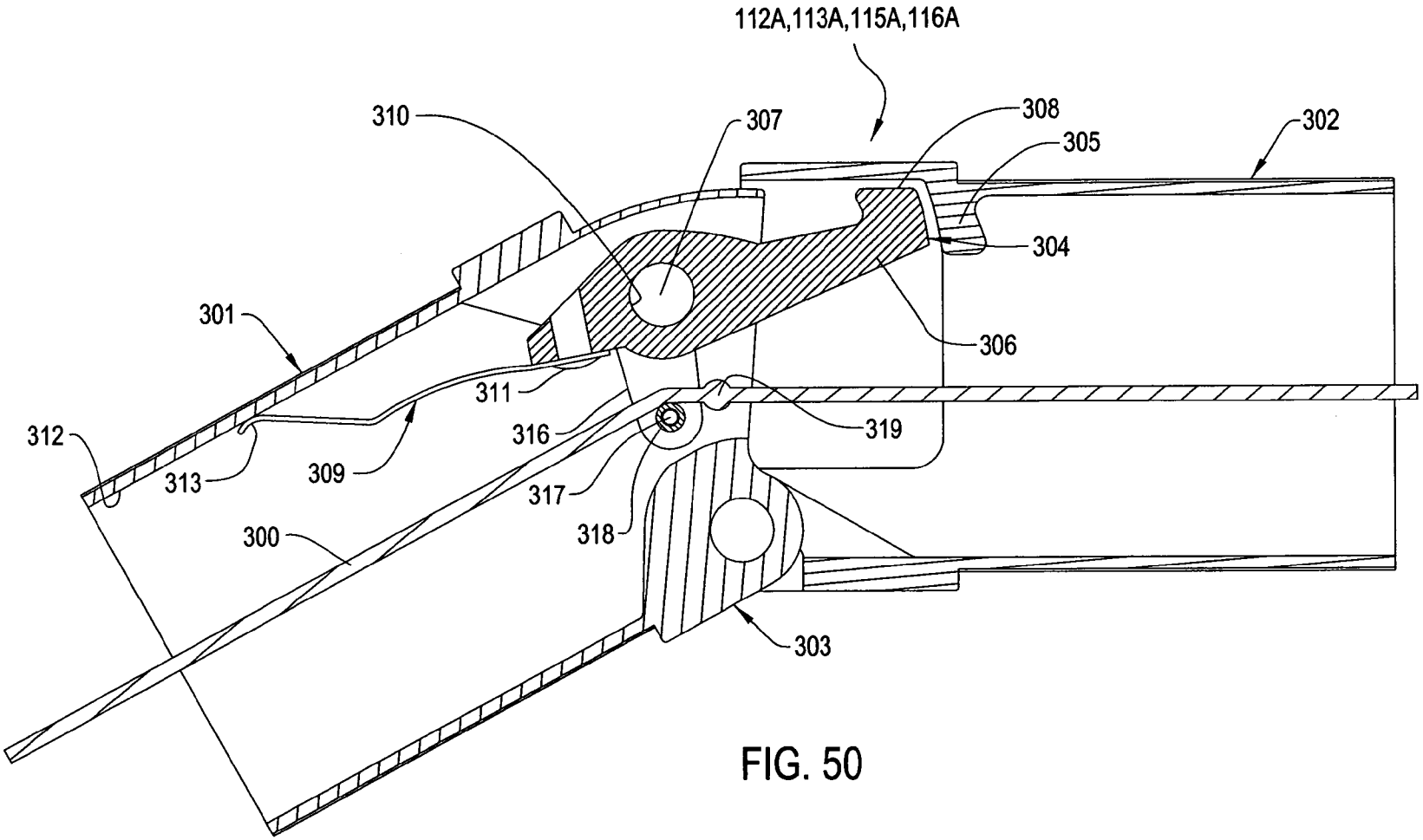
FIG. 50 is a fragmentary view similar to FIG. 57 but illustrating a latch member whose position has been moved.

When it is desired to extend the litter frame head section 111 and/or the litter frame foot section 114, the pin 118 is manually engaged by the attendant and urged in a direction to shift the position of the cable 300 to the left in FIGS. 47-50 to cause the latch pin 127 to be retracted from the FIG. 15 position to the FIG. 16 position to enable the legs 112A, 113A, 115A and 116A to be withdrawn from inside the side rails 66 of the litter frame 17. Simultaneously, the enlargement 319 on the cable 300 is urged leftward from the FIG. 47 position to the FIG. 48 position and causing an urging by the enlargement 319 of the legs 316 leftward therewith to additionally cause the latch member 306 to pivot clockwise to shift the position of the flange 308 away from an abutting relation with the wall 305. As the hinge configuration 303 exits the side rails 66 of the litter frame, relative pivotal movement of the leg sections 301 and 302 will no longer be restricted by the walls of the side rails 66 nor restricted by the flange 308 on the latch member 306 engaging the wall 305. As a result, the leg section 301 will be enabled to pivot about the axis of the hinge configuration 303 to the position illustrated in FIG. 49. Thereafter, the manual force on the pin 118 can be released and the latch pin 127 will be permitted to move from the retracted position illustrated in FIG. 16 to the extended position illustrated in FIG. 15 and to enter into an axially aligned hole provided in the side rails 66 to lock the legs 112A, 113A, 115A and 116A in the extended position. Simultaneously, the return spring force of the leaf spring 309 will cause a movement of the latch member 306 counterclockwise from the position illustrated in FIG. 49 to the position of FIG. 50 whereupon the flange 308 will be moved into engagement with the wall 305. The abutment of the flange 308 with the wall 305 will prevent the leg sections 301 and 302 from pivoting relative to one another about the axis of the hinge configuration 303. The purpose of moving the leg sections 301 and 302 to the angled position illustrated in FIG. 50 is explained below.

Figure 47:
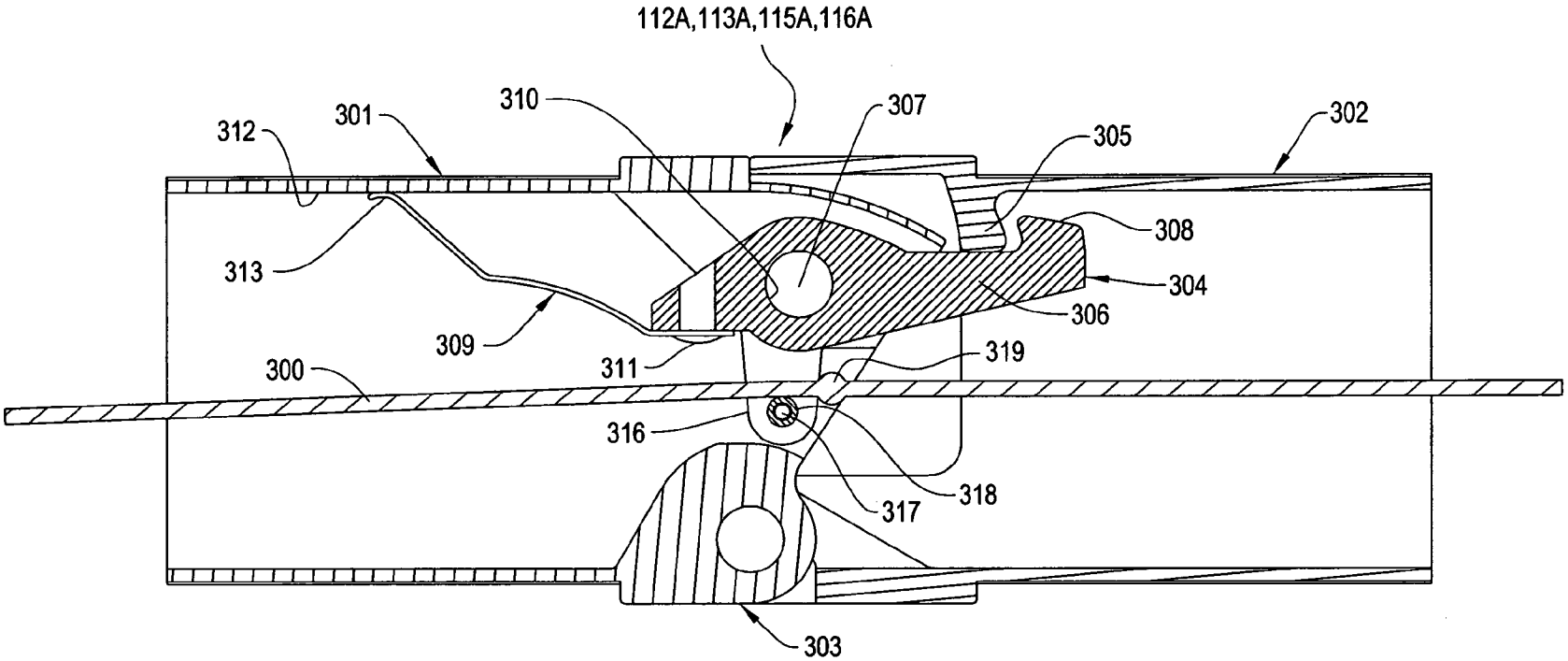
FIG. 47 is a fragmentary view of a modified leg construction for the U-shaped retractable litter frame head and foot sections.

The legs sections 301 and 302 can be returned to the axially aligned position illustrated in FIGS. 47 and 48 by applying a manual force to the pin 118 to cause a movement of the latch member from the FIG. 50 position to the FIG. 49 position and thereafter lifting upward the leg section 301 to cause it to pivot about the axis of the hinge configuration from the FIG. 49 position to the FIG. 48 position and thence to the FIG. 47 position when the manual force on the pin 118 is released.

Swivel Lock for Caster Wheels

Figure 19:
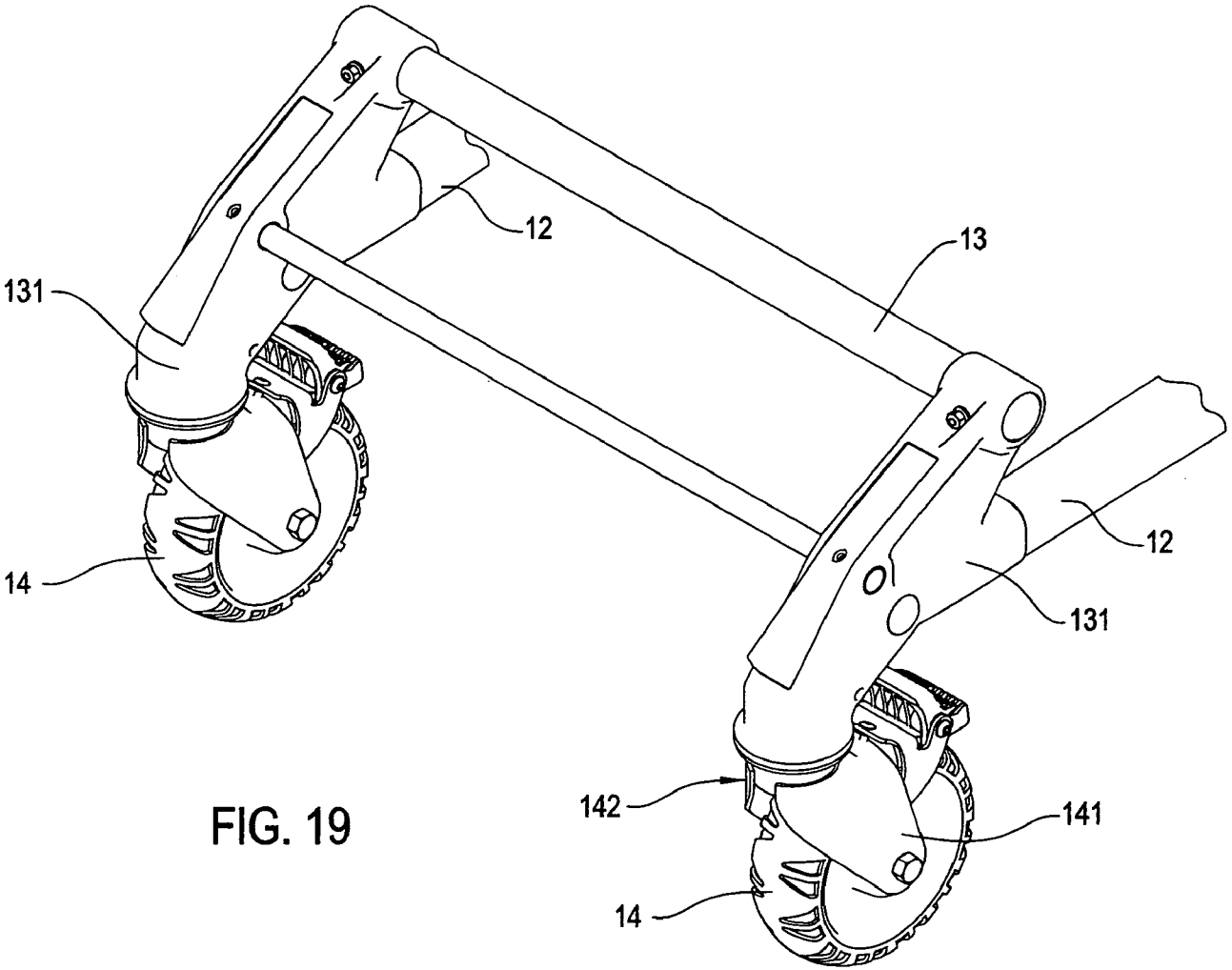
FIG. 19 is an isometric view of a swivel locking mechanism for a caster wheel embodying the invention.
Figure 22:
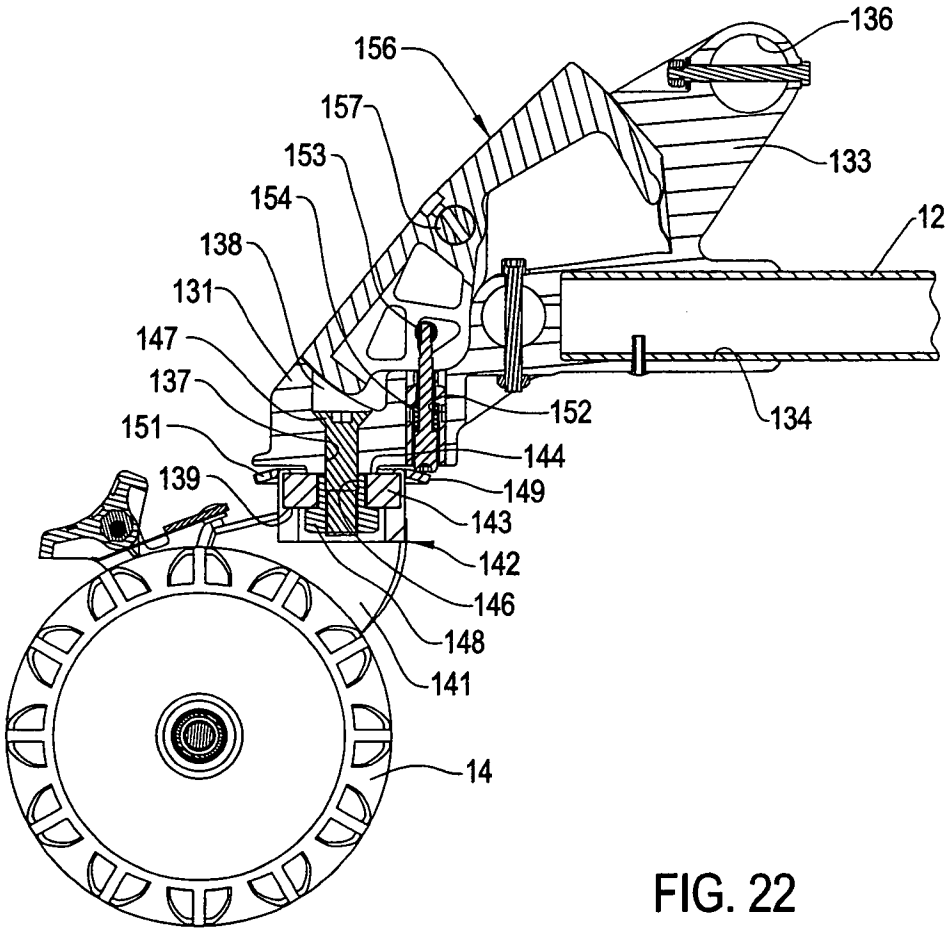
FIG. 22 is a sectional view through the swivel locking mechanism.
Figure 23:
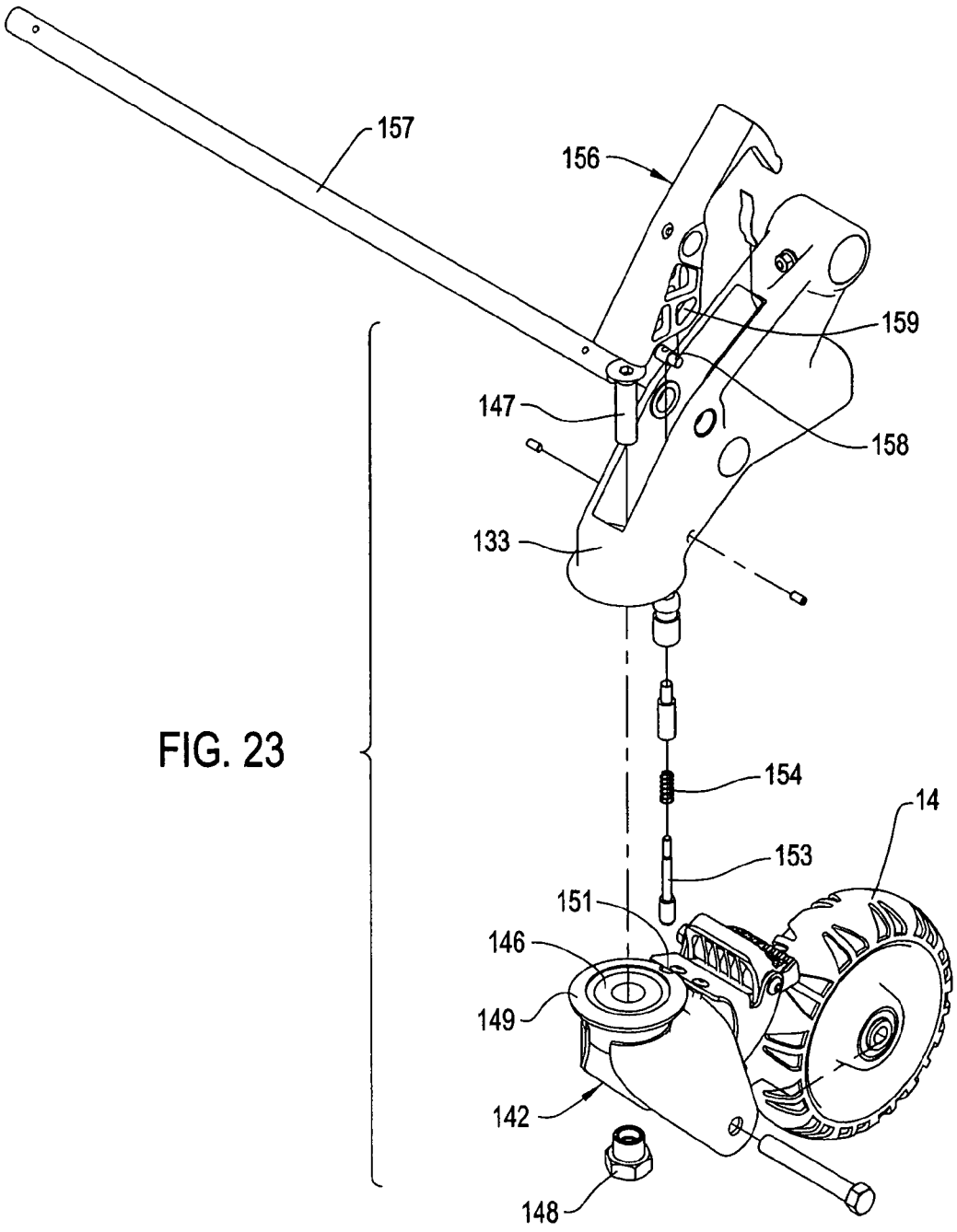
FIG. 23 is an exploded isometric view of the swivel locking mechanism assembly.

Turning now to the head end of the ambulance cot 10 (left end in FIG. 1), a plurality of caster wheels 14 are provided on the base 11. In this particular embodiment, a pair of brackets 131 serve to connect the longitudinally extending side rails 12 to one of the crosswise extending rails 13. An enlargement of the configuration illustrated in FIG. 1 is presented in FIG. 19. Each bracket 131 is identical to the other and includes a housing 133 having sockets 134 and 136 (FIG. 22) configured to receive therein the side rails 12 and the crosswise extending rails 13, respectively. Conventional fasteners are utilized to secure the side rails 12 and the crosswise extending rails 13 in place. Each housing also includes a vertically upright bore 137 extending from an internal cavity 138 and opening outwardly of the body 133 at a downwardly facing, generally horizontal surface 139. Each of the wheels is rotatably supported between a pair of legs 141 of a yoke assembly 142. The yoke assembly 142 includes a sleeve 143 at the upper end thereof having a generally horizontal upwardly facing surface 144 opposed to the surface 139. The sleeve 143 has a hole 144 therein which is axially aligned with the axis of the bore 137. A kingpin 147 is received in the aligned bore 137 and hole 146 and includes an external thread arrangement configured to receive a nut 148 abutting the undersurface of the sleeve 143 to effect a rotational support of the yoke assembly 142 for movement in a 360° pattern about the upright vertical axis of the kingpin 147. A collar 149 (FIG. 23) encircles the upper surface 146 of the sleeve 143 and includes a notch or recess 151 in the perimeter thereof.

Figure 21:
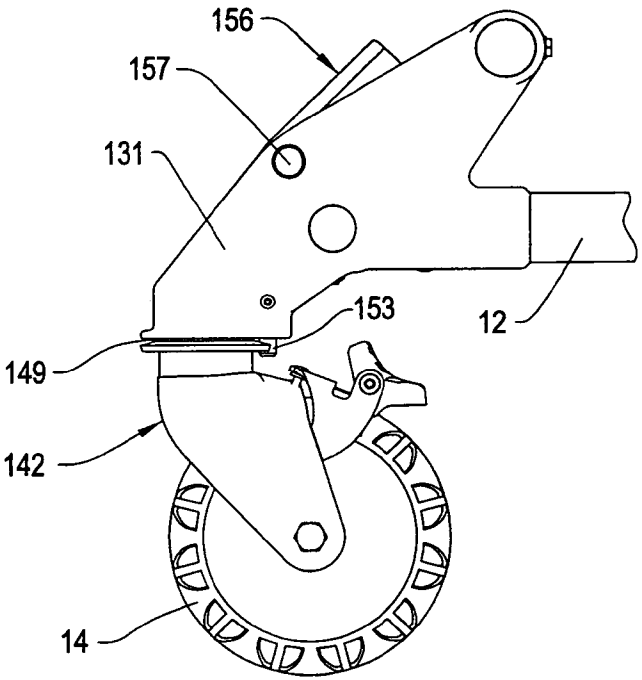
FIG. 21 is a side view similar to FIG. 20, except that the swivel locking mechanism has been activated and the caster is in the locked position.
Figure 20:
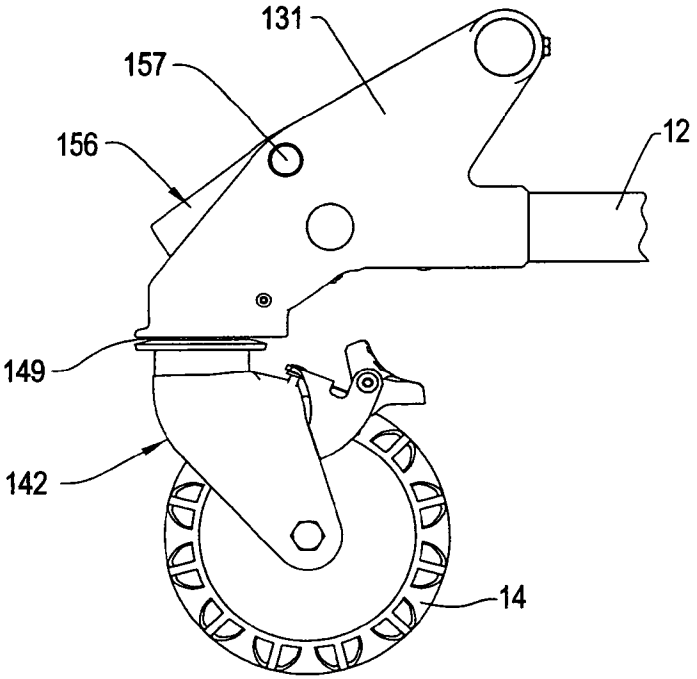
FIG. 20 is a side elevational view of the swivel locking mechanism.
Figure 24:
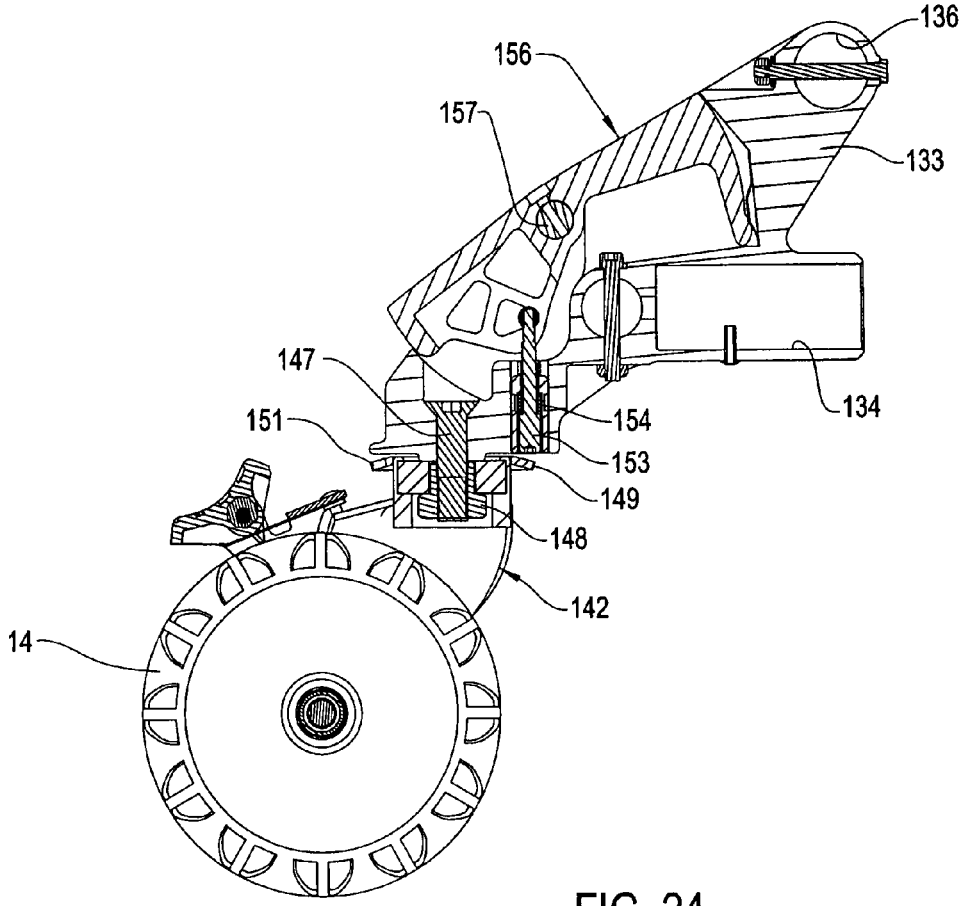
FIG. 24 is a sectional view similar to FIG. 22, except that the swivel locking mechanism has been activated.

Radially outwardly from the axis of the bore 137 there is provided a further bore 152 in which is provided a reciprocal pin 153 urged by a spring 154 to a position wherein the bottom end of the pin 153 projects from the bore 152 as shown in FIGS. 21 and 24.

Figure 25:
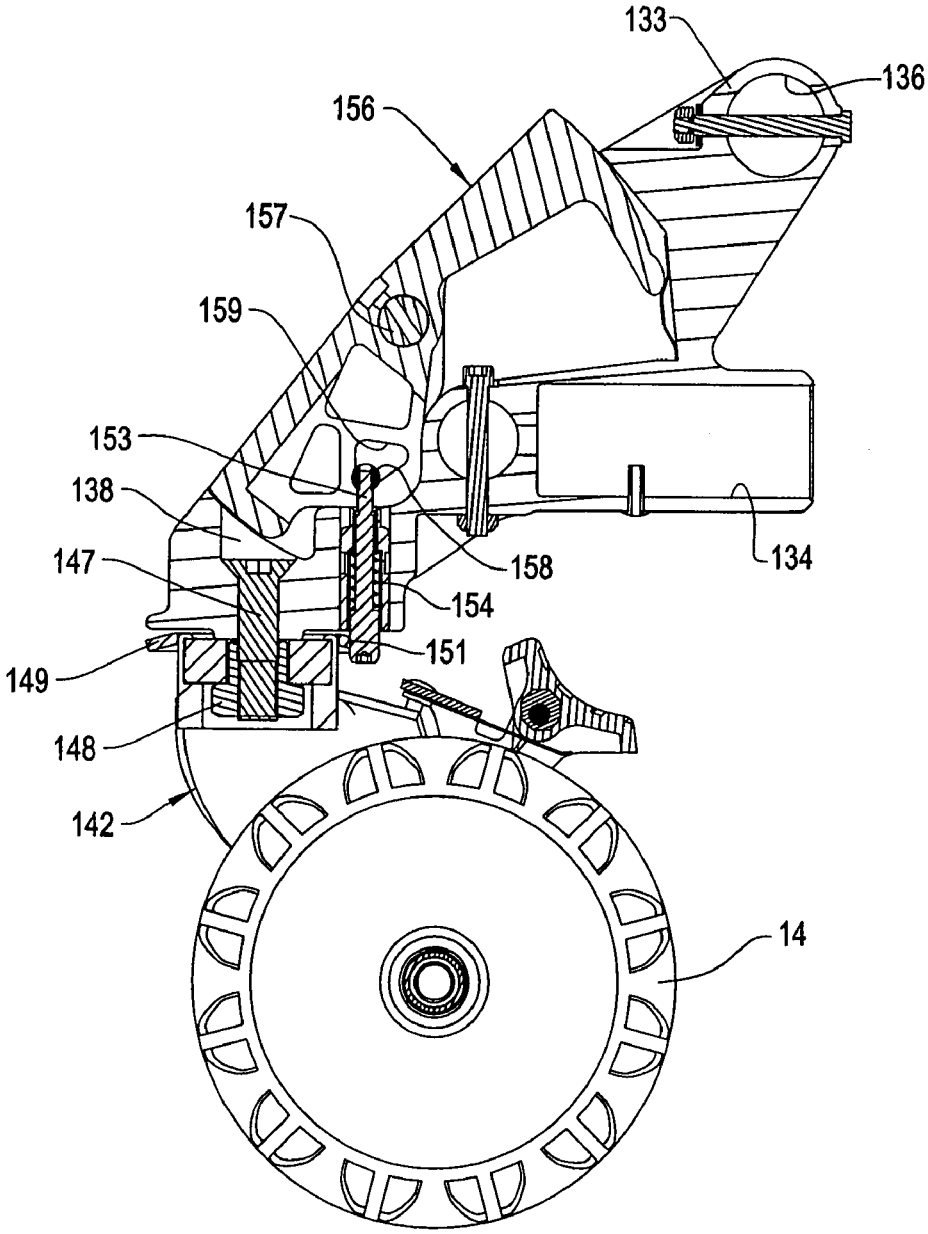
FIG. 25 is a sectional view similar to FIG. 24, except that the caster wheel has been locked so that it can no longer swivel.
Figure 26:
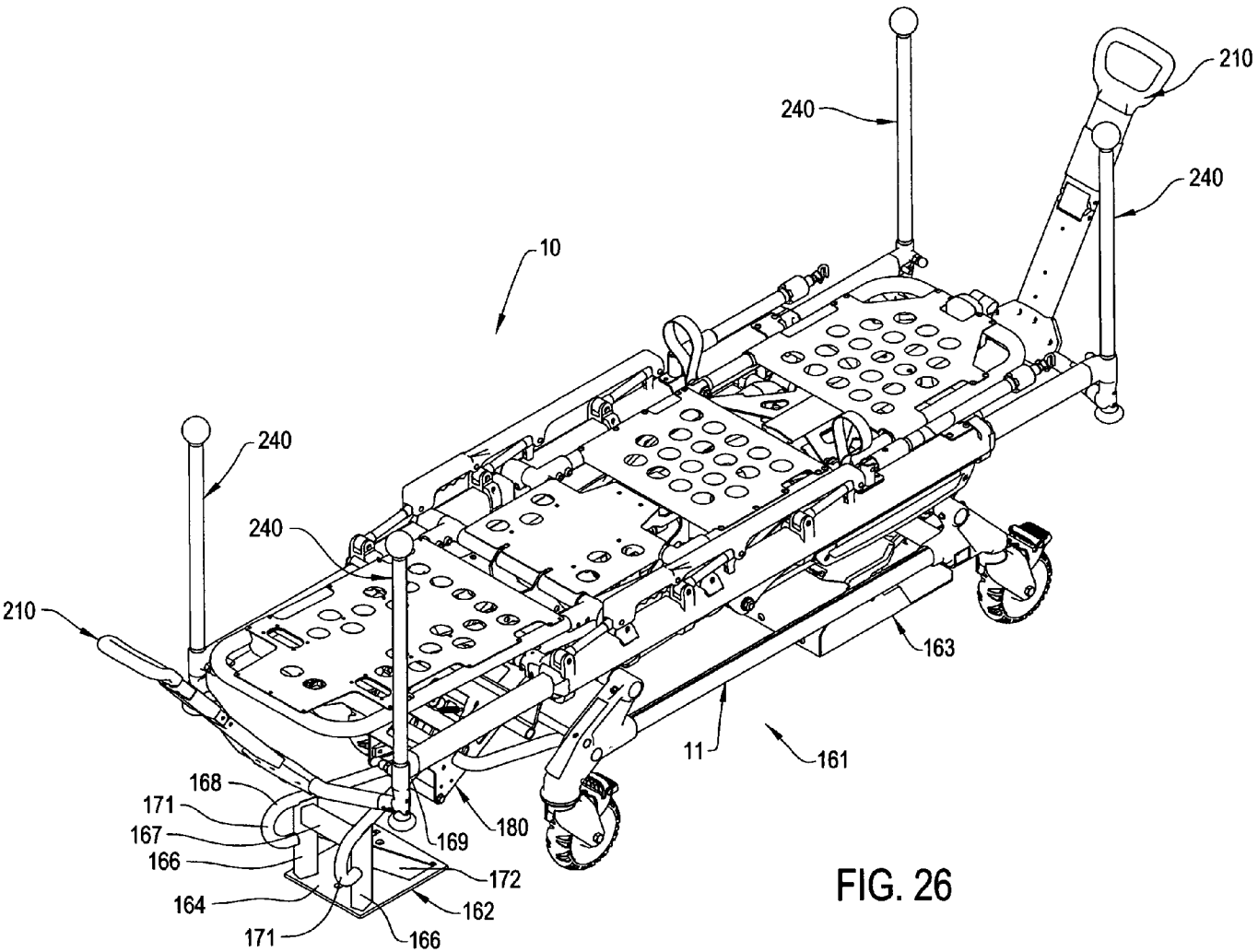
FIG. 26 is a top, right, head end isometric view of an ambulance cot in the lowered position and ready to enter a docking mechanism mounted on the floor of the cargo area of an ambulance.

A toggle lever 156 is pivotally arranged in the cavity 138 for movement about an axle 157. The toggle lever 156 is movable in a teeter totter manner between first and second positions, the first position being illustrated in FIG. 22. The upper end of the pin 153 is loosely secured to the toggle lever 156. More specifically, the upper end of the pin 153 includes a slide member or a roller 158 which engages the surface of an internal cavity 159 provided on the toggle lever 156 so that the toggle lever can undergo a pivoting action facilitating a sliding or rolling movement of the roller 158 with respect to the internal walls of the aforesaid cavity 159. The relative movement between the roller 158 and the internal walls of the cavity 159 can be discerned by comparing FIGS. 22, 24 and 25. Since the internal cavity 159 is oriented below the axle 157, a movement of the toggle lever 156 from the position illustrated in FIG. 22 to the position illustrated in FIG. 24 will shift the relative position of the cavity 159 downwardly and away from the roller 158 oriented at the upper end of the pin 153 to enable the spring 154 to urge the pin 153 downwardly into engagement with the upwardly facing peripheral surface of the collar 149. The position of the yoke assembly 142 illustrated in FIG. 22 has caused the notch 151 to be out of alignment with the axis of the pin 153. When the yoke assembly 142 has been swiveled to the position illustrated in FIG. 25, the notch 151 will have become aligned with the axis of the pin 153 to cause the spring 154 to urge the pin downwardly and into the notch to prevent further pivotal movement of the yoke assembly 142 with respect to the bracket 131. Downward travel of the pin 153 will be limited by an engagement of the roller 158 with a surface of the cavity 159 as illustrated in FIG. 25. To effect a release of the locked castered wheel, one simply needs only to return the toggle lever 156 from the position illustrated in FIGS. 24 and 25 to the position illustrated in FIG. 22. Such movement will cause the roller 158 to engage a surface of the cavity 159 and be lifted thereby moving the pin 153 upwardly in the bore 152 against the urging of the spring 154.

Ambulance Cot Lockdown Mechanism

An ambulance cot lockdown mechanism 161 is illustrated in FIGS. 26 to 34. The ambulance cot lockdown mechanism 161 includes two locking mechanisms, namely, locking mechanism 162 oriented at the head end of the cot and the locking mechanism 163 oriented at the foot end of the cot. The locking mechanism 162 includes a base plate 164 configured to mount to the floor of the cargo area of an ambulance at a location remote from the access opening into the cargo area, preferably adjacent the front end of the cargo area. A pair of pillars 166 are upstandingly secured to the upper surface of the plate 164 and a crosswise extending bar 167 interconnects the upper ends of the pillars 166 to one another. A U or V-shaped bar 168 is oriented so that the apex of the U or V is toward the access opening into the cargo area or, when an ambulance cot is present, oriented toward the foot end of the ambulance cot. In this particular embodiment, the apex 169 is oriented to the right (FIG. 26) of the pillars 166. The legs 168 diverge toward the front end of the cargo area and converge toward the head end of the cot so that each leg can be secured not only to the upper ends of the pillars 166, but also to a mid-length portion of each of the pillars through a rounded extension 171. The legs of the U or V-shaped bar 168 are oriented in a generally horizontal plane spaced upwardly from the plane of the base plate 164. A pair of braces 172 extend between the upper portion of each of the pillars 166 and the top surface of the plate 164 on a side facing the rear of the ambulance.

Figure 27:
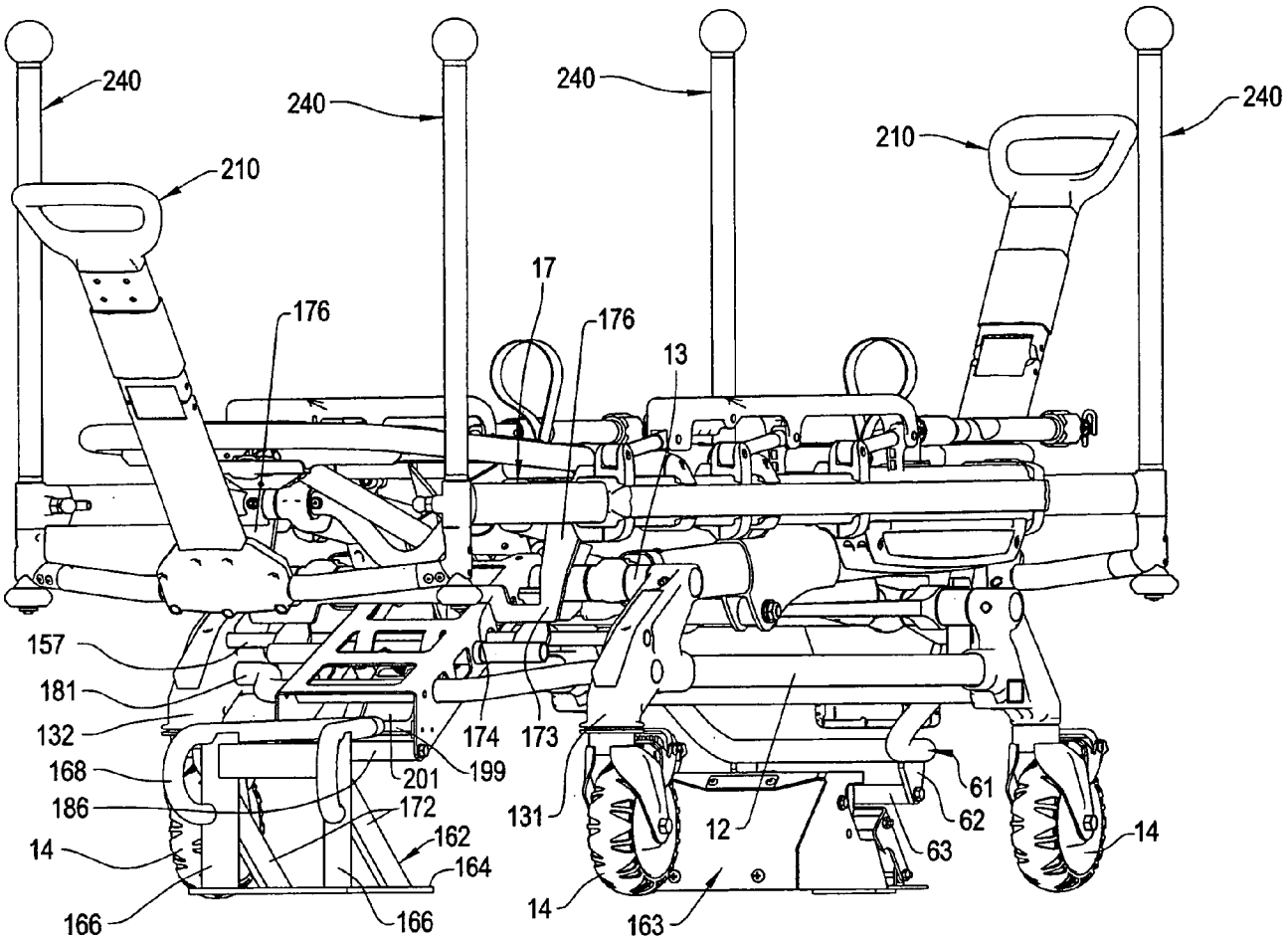
FIG. 27 is a different head end isometric view of FIG. 26 showing the ambulance cot entering the docking mechanism.

Associated with the aforementioned locking mechanism or stanchion 162 is a latch frame 173 (FIG. 27) secured to the underside of the litter frame 17 as illustrated in FIG. 27. The latch frame 173 is, in this particular embodiment, generally U-shaped having a bight section 174 and a pair of upstanding legs 176 secured in a conventional manner to the litter frame 17. The bight section 174 of the latch frame 173 is oriented a finite distance beneath the undersurface of the litter frame 17.

Figure 28:
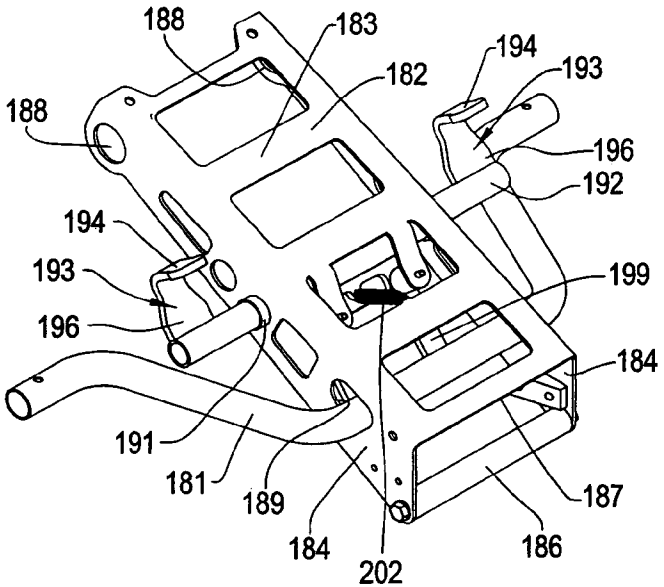
FIG. 28 is an isometric view of the docking mechanism oriented at the head end of the ambulance cot.

A docking mechanism 180 is mounted at the head end of the base frame 11 of the ambulance cot 10. The docking mechanism 180 includes a crosswise extending bar 181 connected to and extending between the brackets 131. The crosswise extending bar 181 is generally parallel to the axle 157 and the crosswise extending bars 13 of the base frame 11. A box-like housing 182 (FIG. 28) includes a top wall 183 and downwardly extending side walls 184. The forward end of the box-like housing 182 has a horizontally extending bar 186 secured to and extending between the side walls 184 adjacent the lower edges thereof as illustrated in FIG. 28. The forward end of the top wall 182, the two side walls 184 and the crosswise extending bar or roller 186 define an opening 187. The rear end of the side walls 184 of the box-like housing 182 have a pair of axially aligned holes 188 therein. The holes 188 receive therein the crosswise extending cross bar 13 of the base frame 11. The crosswise extending bar 181 extends through axially aligned holes 189 oriented adjacent the front end of the box-like housing 182. The box-like housing 182 is oriented centrally between the lateral edges of the ambulance cot 10 as illustrated in FIG. 27.

Figure 29:
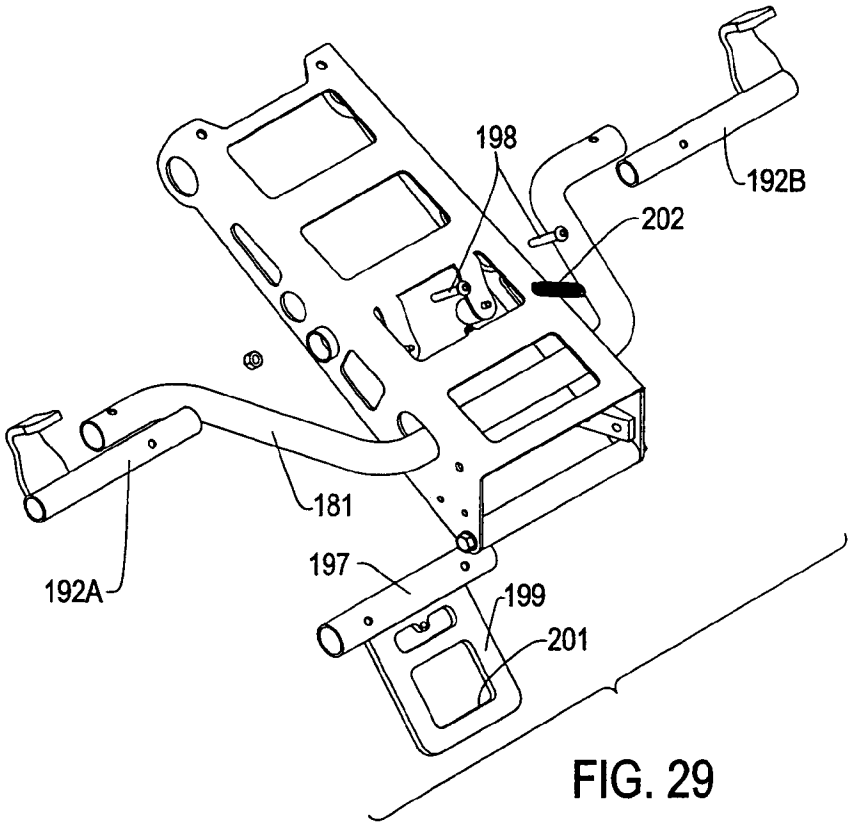
FIG. 29 is an exploded isometric view of the docking mechanism illustrated in FIG. 28.

The side walls 184 of the box-like housing each include a cylindrical bushing 191 into which is received an axle 192. The axially aligned bushings 191 serve to rotatably support the axle 182 therein. A pair of hook members 193 are secured to the opposite ends of the axle 172 and rotate therewith. Each of the hooks 193 is of an inverted L-shaped configuration wherein a leg 194 extends generally at a right angle to the other leg 196. As shown in FIG. 29, the axle 192 is composed of two parts 192A and 192B. These two parts are joined together in a sleeve arrangement 197 and secured together as a unit by a plurality of fasteners 198. A plate 199 is secured to the sleeve arrangement 197 and extends radially outwardly therefrom. A hole 201 is provided in the plate 199. A resilient member, such as a spring 202, is connected to and extends between the plate 199 and the top wall 183 of the box-like housing 182 as illustrated in FIGS. 28-31.

Figure 30:
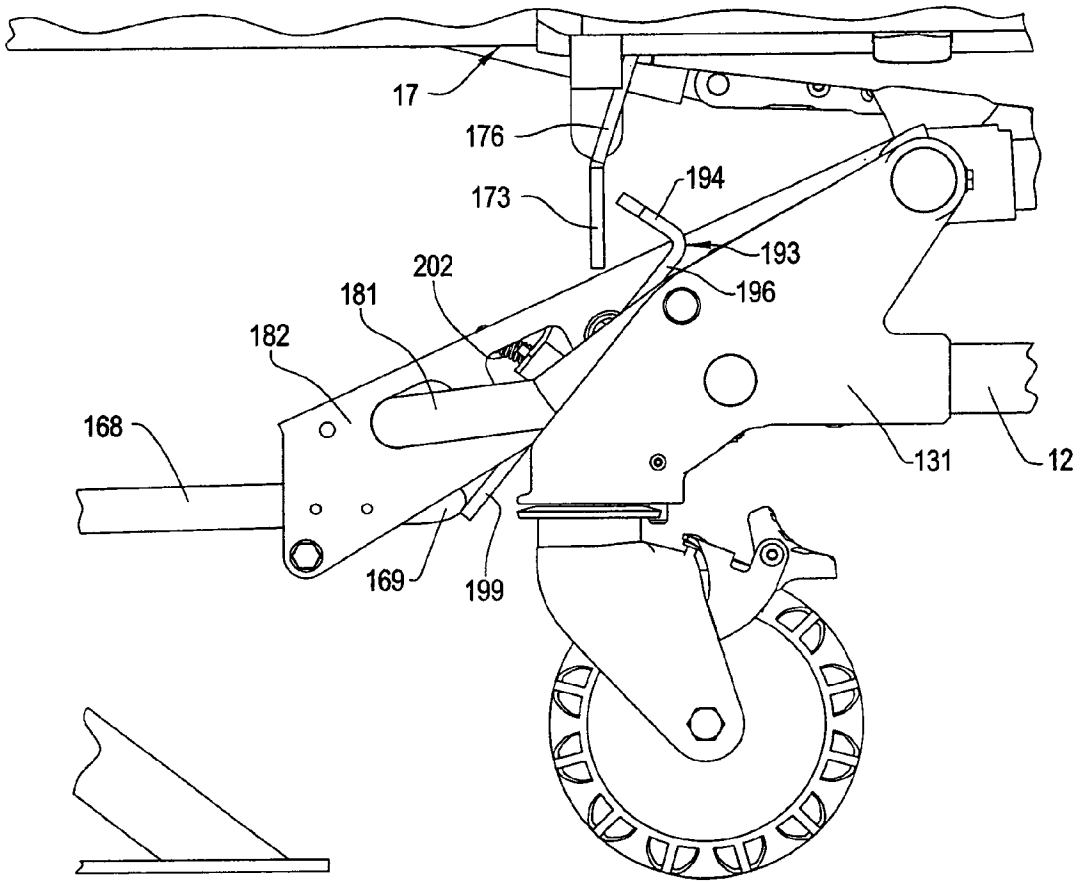
FIG. 30 is a side elevational view of the docking mechanism oriented at the head end of the ambulance cot and prior to the ambulance cot becoming locked into the docking mechanism.
Figure 31:
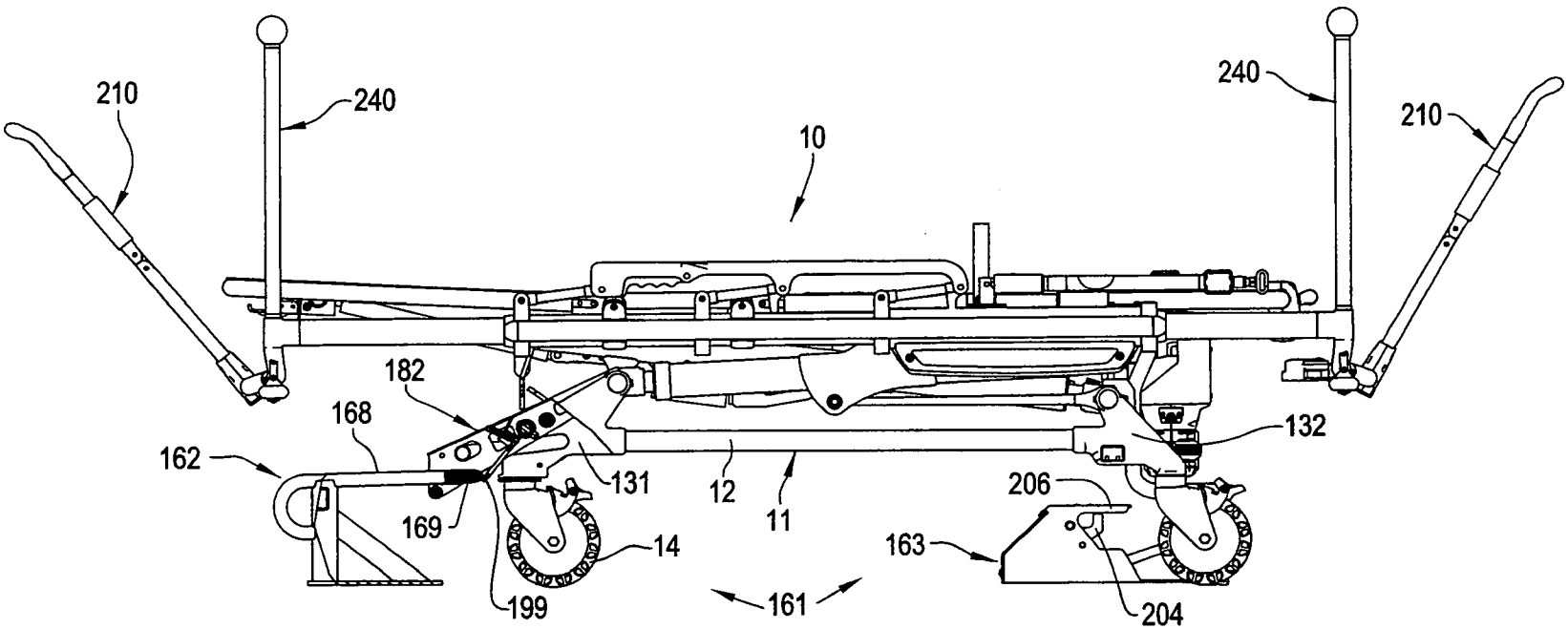
FIG. 31 is a side elevational view of the ambulance cot about to enter the docking system.
Figure 32:
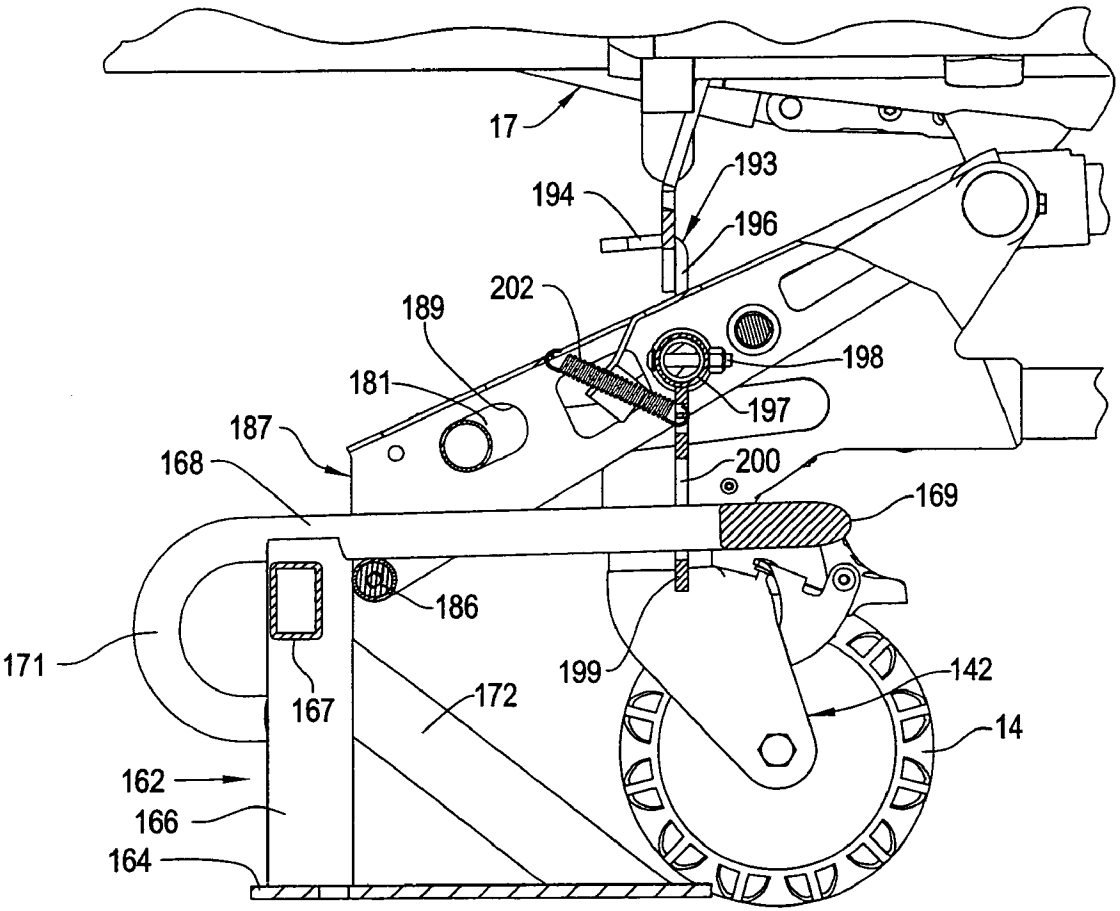
FIG. 32 is a partially sectioned side view of the ambulance cot fully docked into the docking mechanism.
Figure 33:
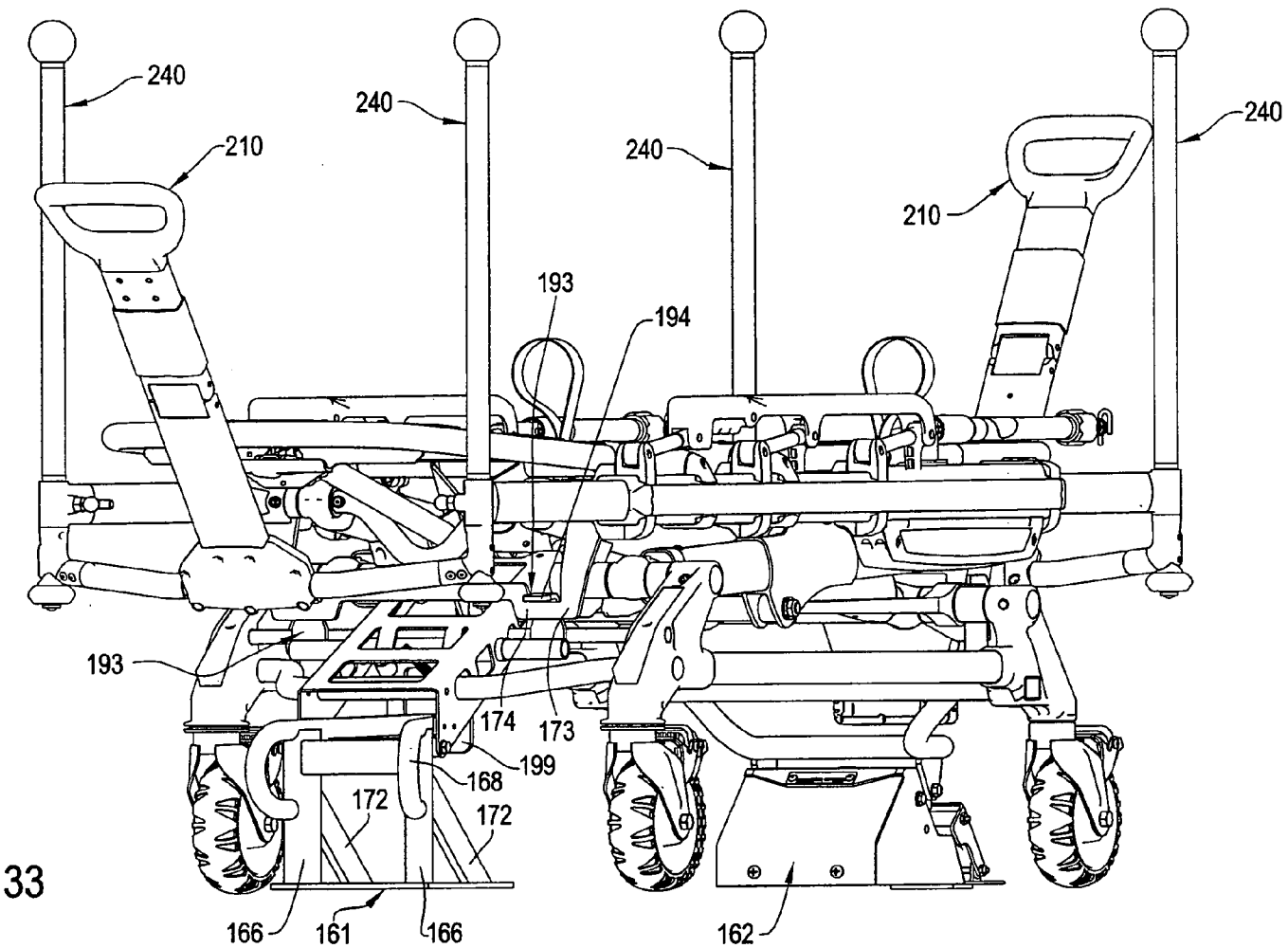
FIG. 33 is an isometric view of the ambulance cot fully docked into the docking mechanism.
Figure 34:
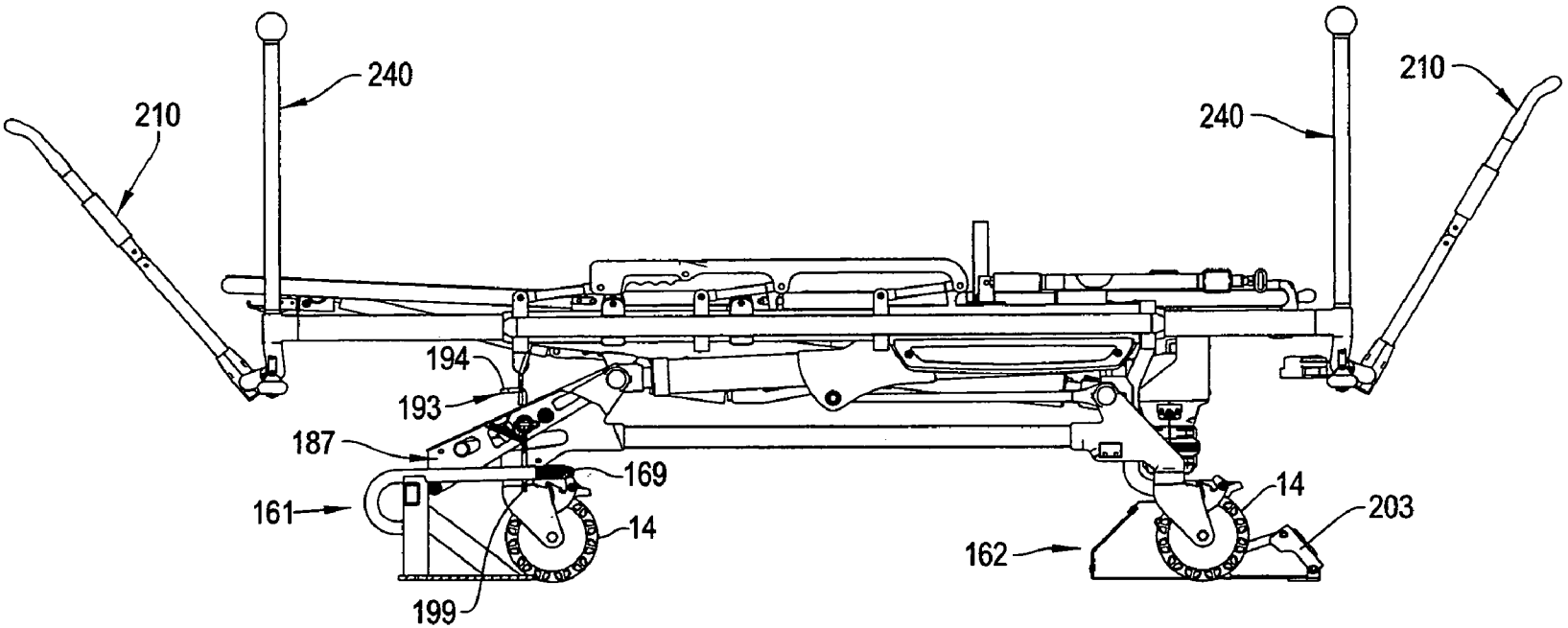
FIG. 34 is a side elevational view of the ambulance cot fully docked into the docking system.

As an ambulance cot 10 is loaded into the cargo area of an ambulance and moved toward the stanchion 162, the apex 169 of the U or V-shaped bar 168 will first enter the opening 187 of the box-like housing 182 and engage the plate 199 as illustrated in FIGS. 30 and 31. The U or V-shaped bar moves over the top of the bar or roller 186 on the box-like housing 182. Continued movement of the ambulance cot to the left in FIG. 30 will cause the apex 169 to enter the hole 201 in the plate 199 as the plate becomes more vertical so that each leg of the U or V-shaped bar 168 will serve to center the hole 200 and the cot while at the same time cranking the plate 199 from the position illustrated in FIG. 30 to the position illustrated in FIGS. 32-34 at which time the leg 194 of the hook 193 will move over the top of the bight section 174 of the latch frame 173 as illustrated in FIGS. 32-34. In this manner, the litter frame 17 is locked to the floor of the cargo area of the ambulance cot.

The locking mechanism 162 oriented adjacent the foot end of the cot includes a foot pedal 203 which, when activated, effects through a linkage the movement of a latch bar 204 from the position illustrated in FIG. 31 to an unlatched position ready to receive beneath the overhang 206 the latch bar 63 as shown in FIG. 27. As the latch bar 63 moves beneath the overhang 206, it will strike the other part of the latch bar 204 to cause the latch to move over dead center bringing the latch bar to the position illustrated in FIG. 3 locking the latch bar 63 to the locking mechanism 162.

Pull Handles

Figure 35:
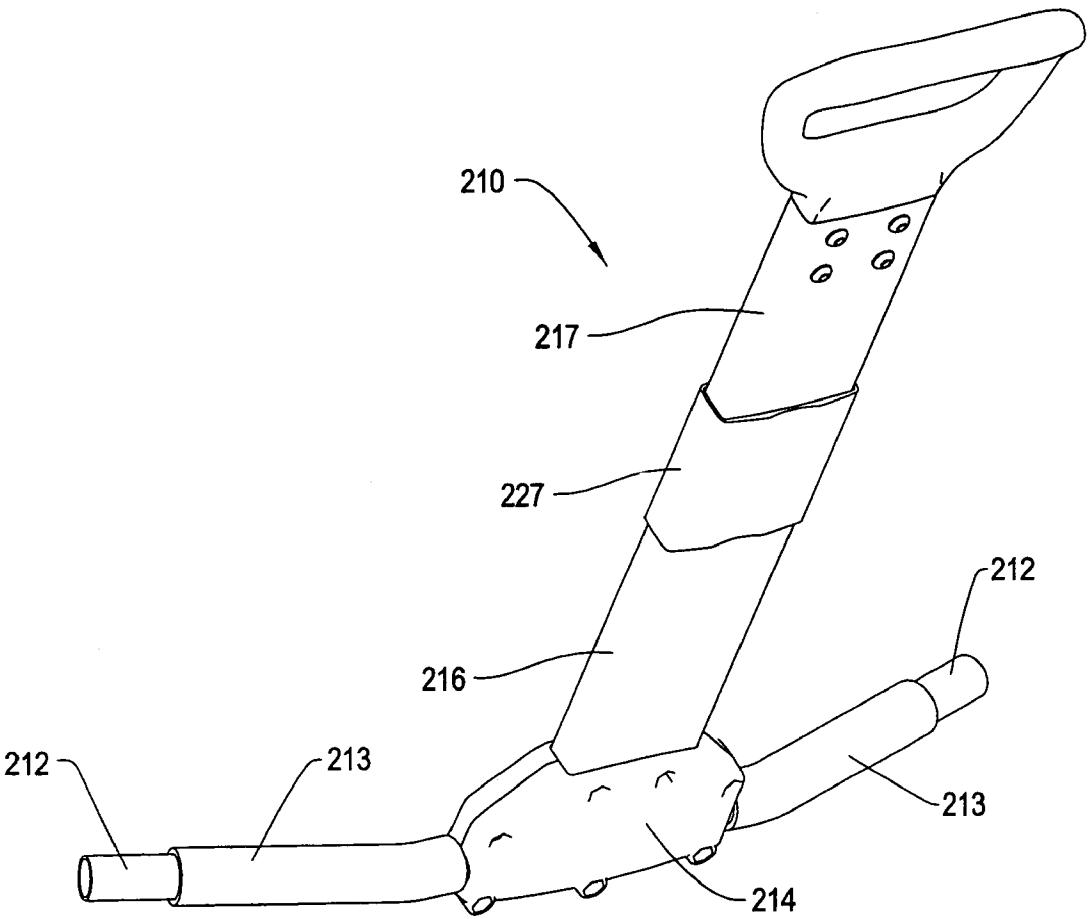
FIG. 35 is an isometric view of a pull handle provided at the head end and foot end of the ambulance cot.
Figure 36:
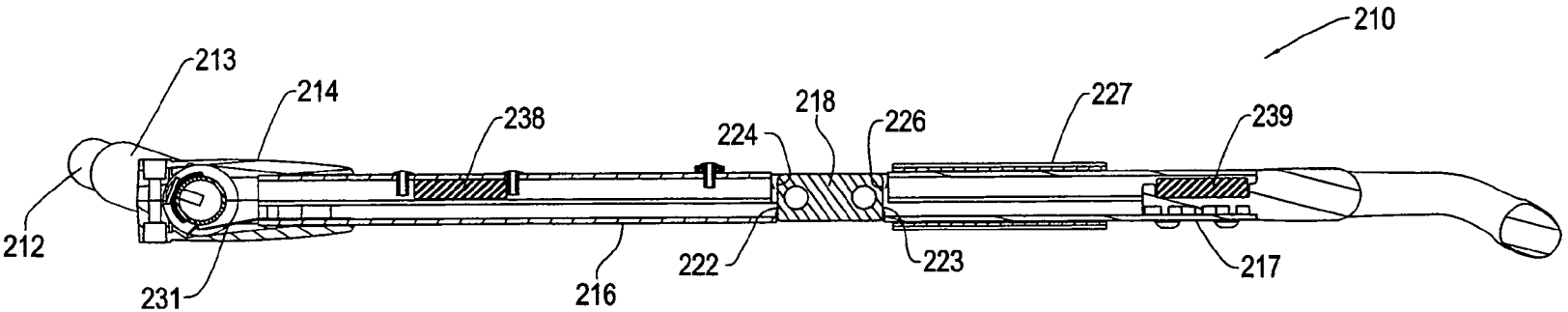
FIG. 36 is a longitudinal sectional view through the length of the handle.
Figure 37:
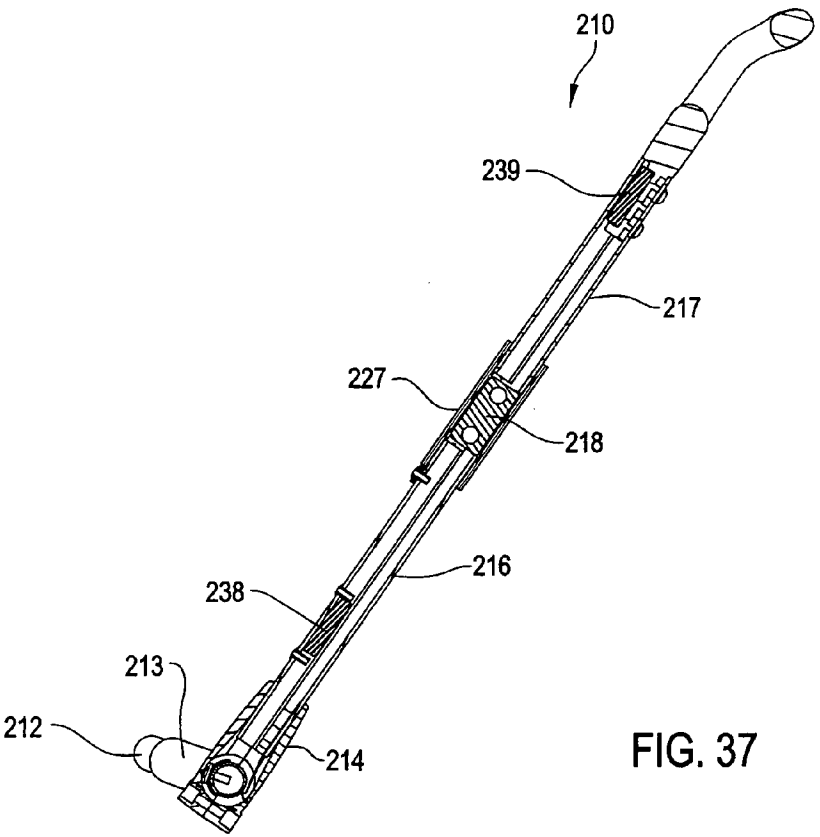
FIG. 37 is a central longitudinal sectional view of the handle in an operative position thereof.
Figure 38:
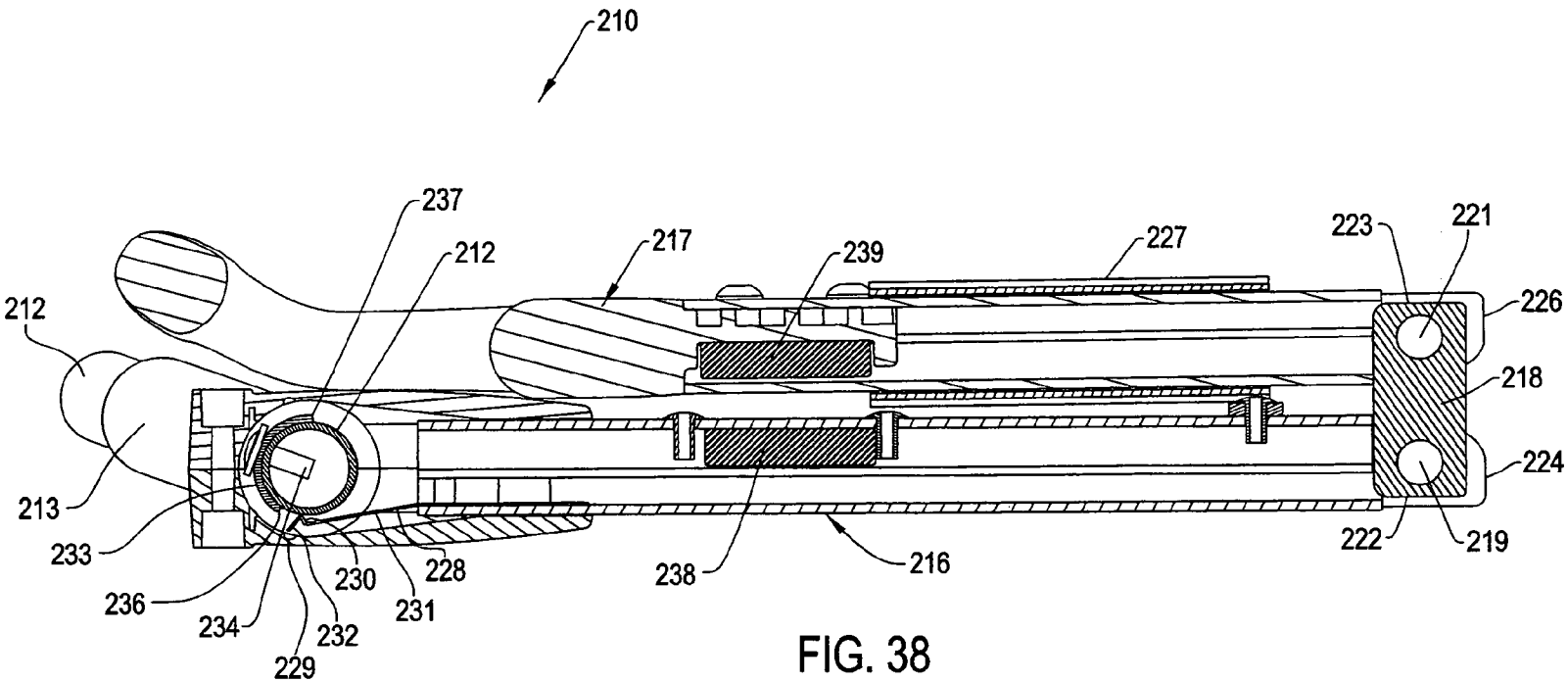
FIG. 38 is a longitudinal sectional view of the handle in its folded condition.

A pair of identical pull handles 210 are oriented on the litter frame 17 at the head end and foot end of the ambulance cot 10. Each of the retractable head section 111 and foot section 114 includes bracketry 211 at each of the four corners interconnecting the respective legs 112, 113, 115, 116 to a crosswise extending bar 212 having a pair of laterally spaced rubber hand grips 213 (FIG. 35) provided thereon. At a central location on each of the two bars 212 and between the hand grips 213 there is provided a connector housing 214 that facilitates the connection of the pull handle 210 to the bar 212. In this particular embodiment, the connector housing 214 is rotatable relative to the bar 212 by a loosely provided clam shell type of clamp so that the handles 210 can be oriented at the position illustrated in FIG. 1 to a fully stowed position illustrated in FIG. 39. Each handle 210 consists of a first part 216 connected to the connection housing 214 and a second part 217 connected to the first part through a hinge 218. In this particular embodiment, the hinge 218 includes two mutually exclusive axles 219 and 221. The first part of the handle 216 is connected to the hinge 218 through the axle 219 whereas the second part 217 of the handle is connected to a second axle 221 to the hinge 218. This configuration of the hinge will allow the first and second parts to move to an overlapped array as illustrated in FIG. 38. The hinge 218 includes flat end surfaces 222 and 223 so that when the handle 210 is moved to the unfolded position, the flat end surfaces 224 and 226 on the first and second handle parts 216 and 217, respectively, will engage the flat end surfaces 222 and 223 to prevent the handle parts moving past the linearly aligned position shown in FIG. 36. A sleeve 222 is provided on the second handle part 217 and, when the handle is in the position illustrated in FIG. 36 wherein the handle parts 216 and 217 are generally collinear, the sleeve 222 can slide to the left to enshroud the hinge 218 to prevent the first and second parts from moving relative to the hinge as shown in FIG. 37. Once the handle 214 has been appropriately folded to the FIG. 38 position, it can then be allowed to pivot about the axle defined by the crosswise extending bars 212 to a stowed position beneath the litter frame 17 as shown in FIG. 39.

A spring clip 231 is mounted on the inside of the connection housing 214 and includes a barb-like configuration 232 that slides on the outer surface of the crosswise extending bar 212. The bar 212 includes a partial, generally C-shaped collar piece 233 of a finite thickness fastened to the outer surface thereof by a fastener 234. The collar piece 233 has end walls that are contained in a plane that includes the axis of the bar 212. The spring clip 231 has a finite width and includes a straight section 228 terminating in the barb-like configuration 232 which is of a generally V-shape. A first leg 229 of the V-shaped barb 232 constitutes a terminal end section of the spring clip and it is inclined to a plane containing the straight section 228 and inclined to a radius of the bar 212. A second leg 230 of the V-shaped barb is oriented in a plane that is generally perpendicular to the plane containing the straight section 228 and a radius of the bar 212. As the handle 210 is moved from the FIG. 38 position to the stowed position illustrated in FIG. 39, the inclined first leg 229 of the barb-like configuration 232 will slide up over a corner 236 of the collar piece 233, the apex of the "V" sliding along the radially outer surface 237 of the collar and then snap down on the far side thereof at the corner 237 so that second leg section 230 engages the flat end wall surface of the collar piece 233 (as shown in FIG. 39) to effectively releasably lock the handle in the stowed position beneath the respective retractable head end and foot end sections 111 and 114 of the litter frame 17. To move the folded handle from the position shown in FIG. 39 to, for example, the position shown in FIG. 38, one need only forcibly pull down on the folded configuration at the end remote from the connection housing 214 to cause the second leg section 230 of the spring clip 231 to flex into a plane inclined to the plane containing the straight section 228 and the radius of the bar 212 to thereby enable the barb 232 to lift up over the corner 237. A first magnet 238 is fixedly mounted to the first handle part 216 and a second magnet 239 is fixedly mounted to the second handle part 217 at generally the same distance from the hinge 218. As result, and when the handle parts 216 and 217 are folded to the FIGS. 38 and 39 positions, the magnets will attract and releasably hold the handle parts together. Furthermore, when the folded handle 210 is moved to the stowed position illustrated in FIG. 39, the second handle part 217 will not be able to separate from the first handle part 216 due to the attractive force provided by the magnets 238 and 239.

Figure 39:
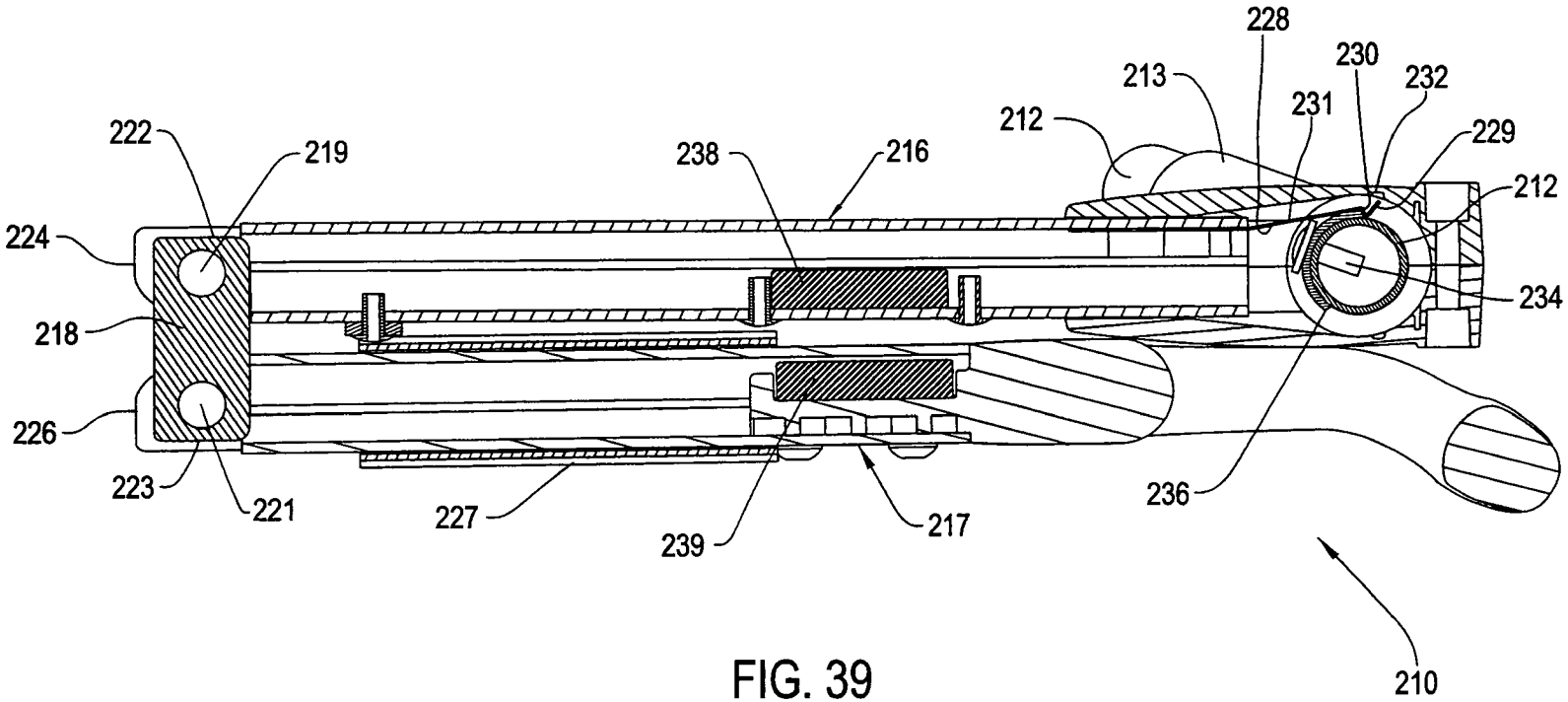
FIG. 39 is a central sectional view of the handle in the folded position and shifted to a stowed position.
Figure 40:
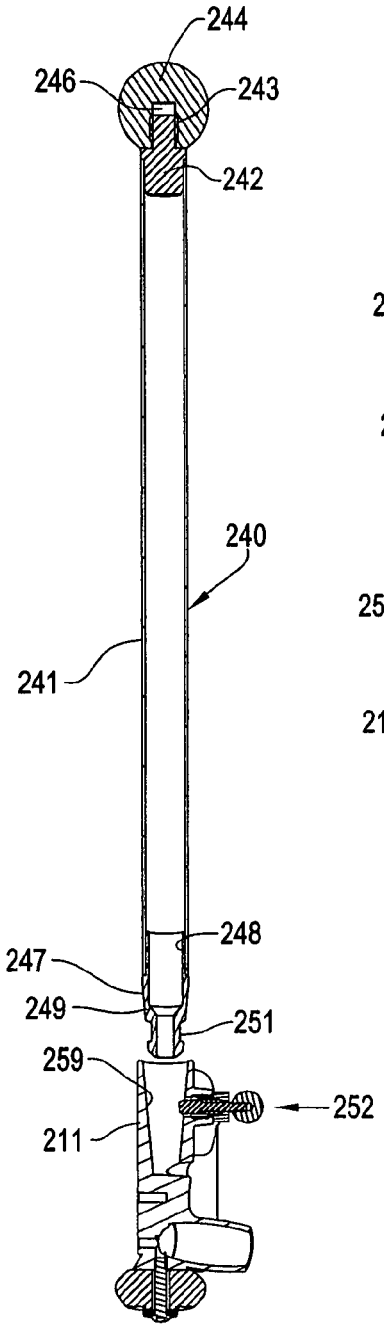
FIG. 40 is a longitudinal sectional view through one of the push bars spaced from a socket configuration therefor.

When the handles 210 are in the folded and stowed position shown in FIG. 39, the hand grips 213 will be more easily accessed by the attendants. When the litter frame is in the elevated position illustrated in FIG. 3, for example, the hand grips 213 may not be positioned at the correct elevation, such as too high, for some attendants to facilitate the attendant comfortably lifting one end of the cot away from the ground. Referring to FIGS. 47-50 discussed above, the attendant can apply a manual force to the pin 118 (FIG. 15) to begin the task of lowering the hand grips 213 on the respective leg sections 301 to a more comfortable height, such as shown in broken lines in FIG. 3. The preferred location for the hand grips 213 to be positioned is at a height close to where the palms of the hands of the attendant are located when the attendant is in a standing position with his/her arms hanging straight down with the palms of the hands facing forward. Effecting a movement of the respective leg sections 301 to the position illustrated in FIG. 50 will so position the hand grips 213 for most attendants.

Push Bars

As is illustrated in FIG. 1, there are four identical upstanding posts or push bars 240 in each of the four corners of the ambulance cot 10. Each post or push bar 240 includes an elongate tube 241 having received in an upper end thereof a plug 242 having an externally threaded stub section 243 thereon. A ball-shaped element 244 having an internally threaded socket 246 therein receives the externally threaded stub 243 to facilitate a screwed securement of the ball 244 to the tube 241. A locking sleeve 247 includes an upper section 248 that is telescopingly received inside the lower end of the tube 241. The locking sleeve 247 includes a section 249 that extends beyond the end of the tube 241 and has an annular groove 251 in the periphery thereof adjacent the lower terminal end as best illustrated in FIG. 41.

Figure 14:
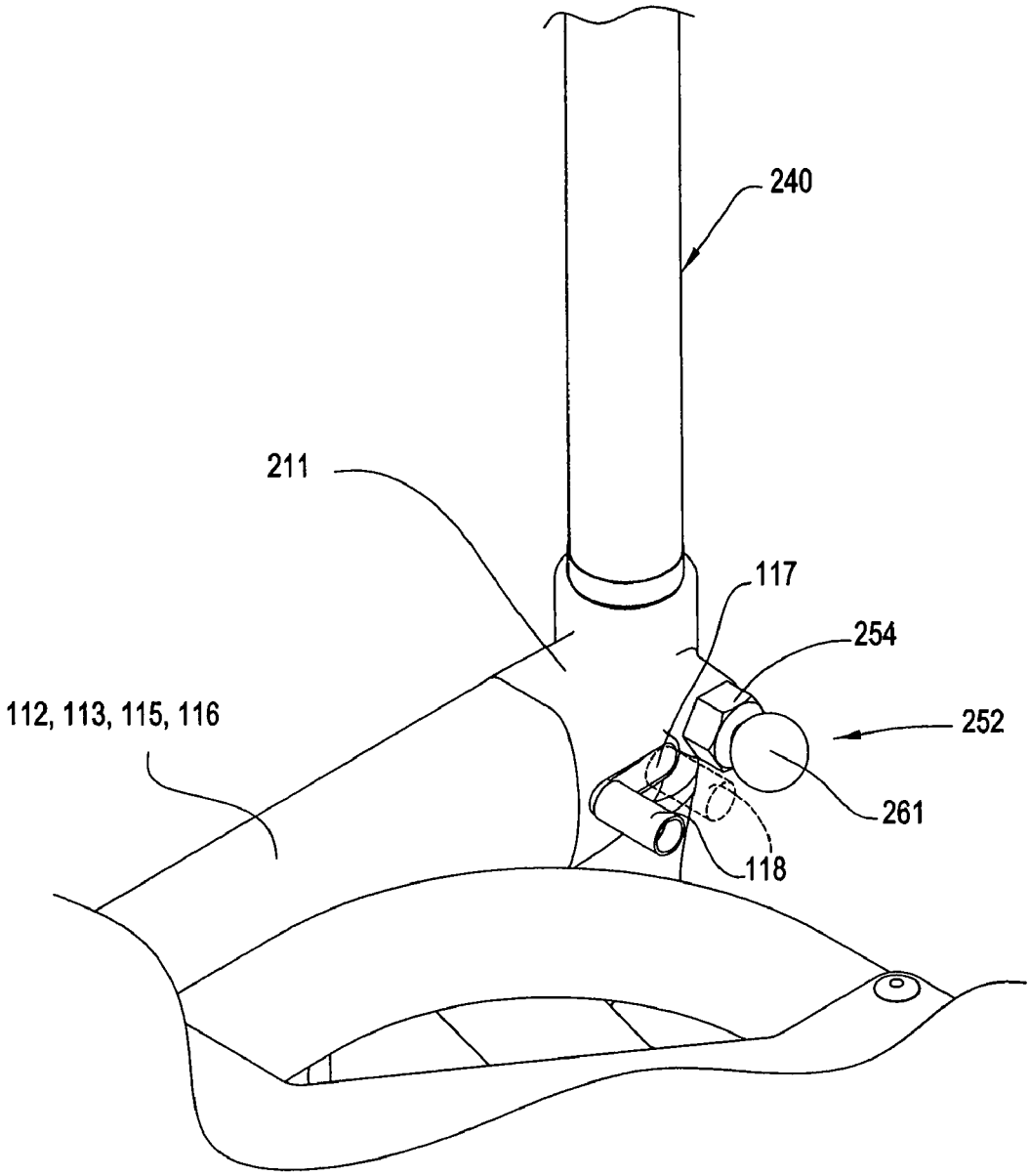
FIG. 14 is an enlargement of the encircled part XIV of the corner section of the litter frame illustrated in FIG. 1.
Figure 41:
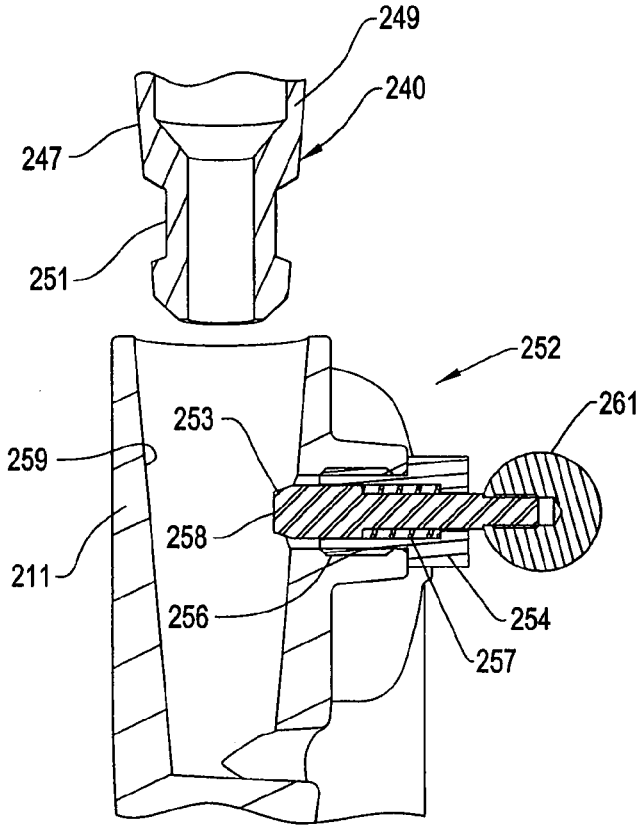
FIG. 41 is an enlargement of the encircled fragment XLI in FIG. 40.

Referring to FIG. 14, the bracket 211 in each corner of the cot includes a push bar locking mechanism 252 as is illustrated in FIG. 41. The push bar locking mechanism 252 includes a pin 253 supported for reciprocal movement in a sleeve 254 that is threadedly engaged as at 256 with the wall structure of the bracket 211. A spring 257 is oriented between an external surface of the pin 253 and an internal surface of the sleeve 254 to effect a continual urging of the pin 253 to the position illustrated in FIG. 41 wherein the internal end of the pin 258 projects into a socket 259 that is provided in each of the brackets 211 for reception of the locking sleeve 247. As is illustrated in FIG. 41, both the extension 247 and the socket 259 into which the extension 247 is received are conformingly tapered so that as the extension sleeve 247 is received into the socket 259. A snug and tolerance free mating of the respective surfaces will occur to tightly hold the push rod 240 in each of the respective sockets 259. A knob 261 is provided on the outside end of the pin 253 and is threadedly secured thereat to the pin 253. The knob 261 serves the purpose of enabling an attendant to manually grasp the knob and pull it rightwardly in FIG. 41 to cause the pin 253 to be retracted into the interior of the sleeve 254 against the urging of the spring 257.

Figure 42:
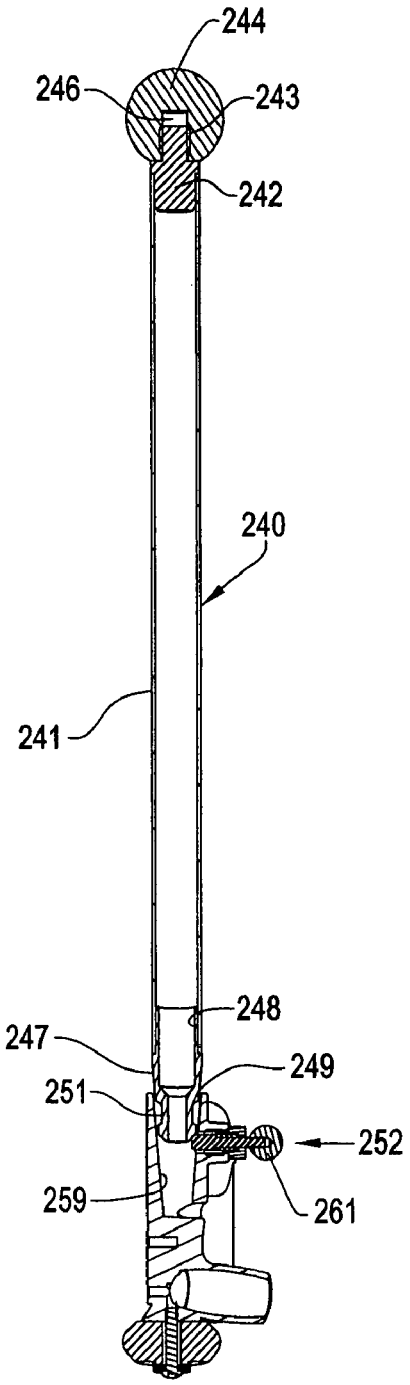
FIG. 42 is a longitudinal sectional view similar to FIG. 40 except that the push bar has entered the socket.
Figure 43:
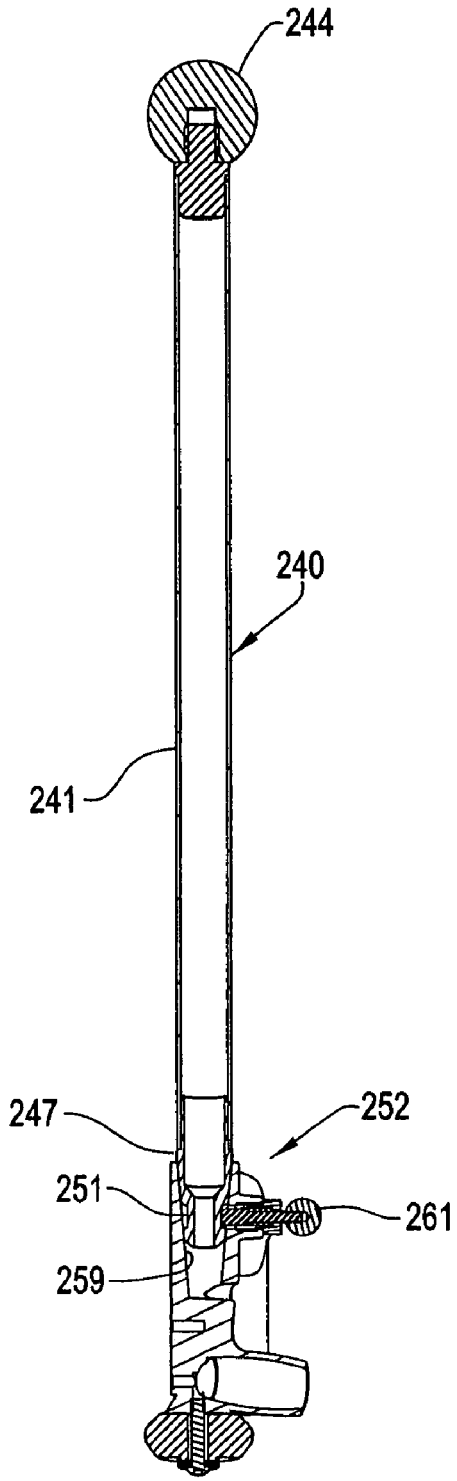
FIG. 43 is a longitudinal sectional view similar to FIG. 42 except that the push bar is locked into the socket by a lock mechanism.
Figure 44:
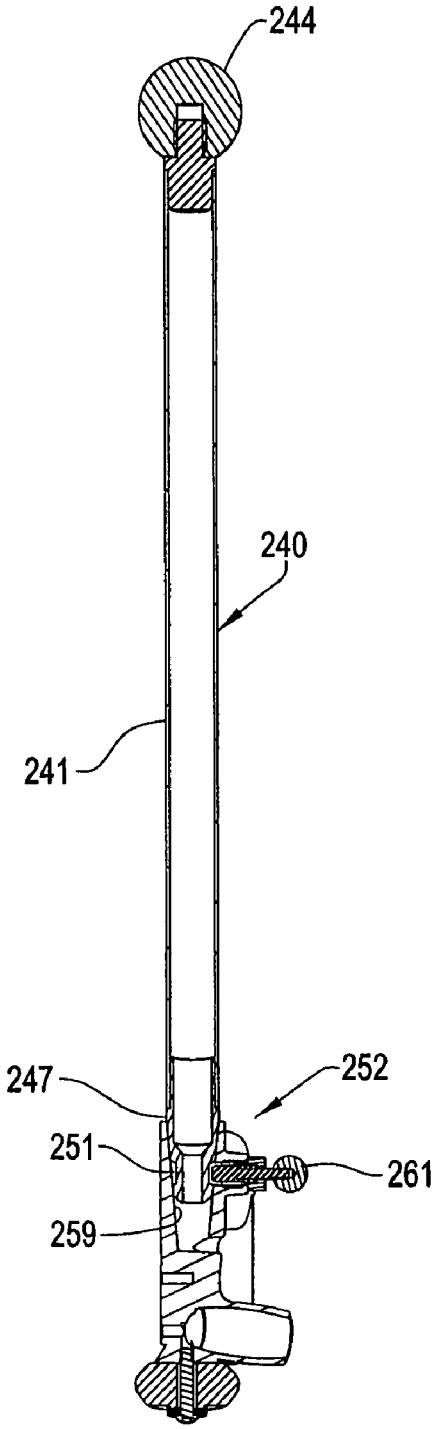
FIG. 44 is a longitudinal sectional view similar to FIG. 43, except that the lock mechanism has been moved to the unlocked position.

FIGS. 42 and 43 illustrate a sequence of movement of the push bar 240 into the socket 259 provided in each of the brackets 211. As a downward force is applied to each of the push bars 240, the lower end of the locking sleeve 247 engages the inner end 258 of the pin 253 to urge it rightwardly (FIG. 41) into the sleeve 254 to facilitate continued downward movement of the push bar to the position illustrated in FIG. 43 whereat the spring force of the spring 257 urges the inner end 258 of the pin 253 into the annular groove 251 provided in the exterior surface of the locking sleeve 247. Conforming surfaces on the extension 247 and pin 253 facilitate the aforesaid action. FIG. 44 illustrates that in order to facilitate a removal of the push rod from the respective socket 259, it is necessary to move the pin 253 to its retracted position by manually pulling rightwardly on the knob 261.

It is sometimes desired to move a patient located on the patient support deck 60 while the patient support deck is in the lowered position thereof, such as the position of the ambulance cot illustrated in FIG. 31. The pull handles 210 and the push bars 240 will facilitate an easy manipulation of the ambulance cot while it is in the lowered position.

Figure 45:
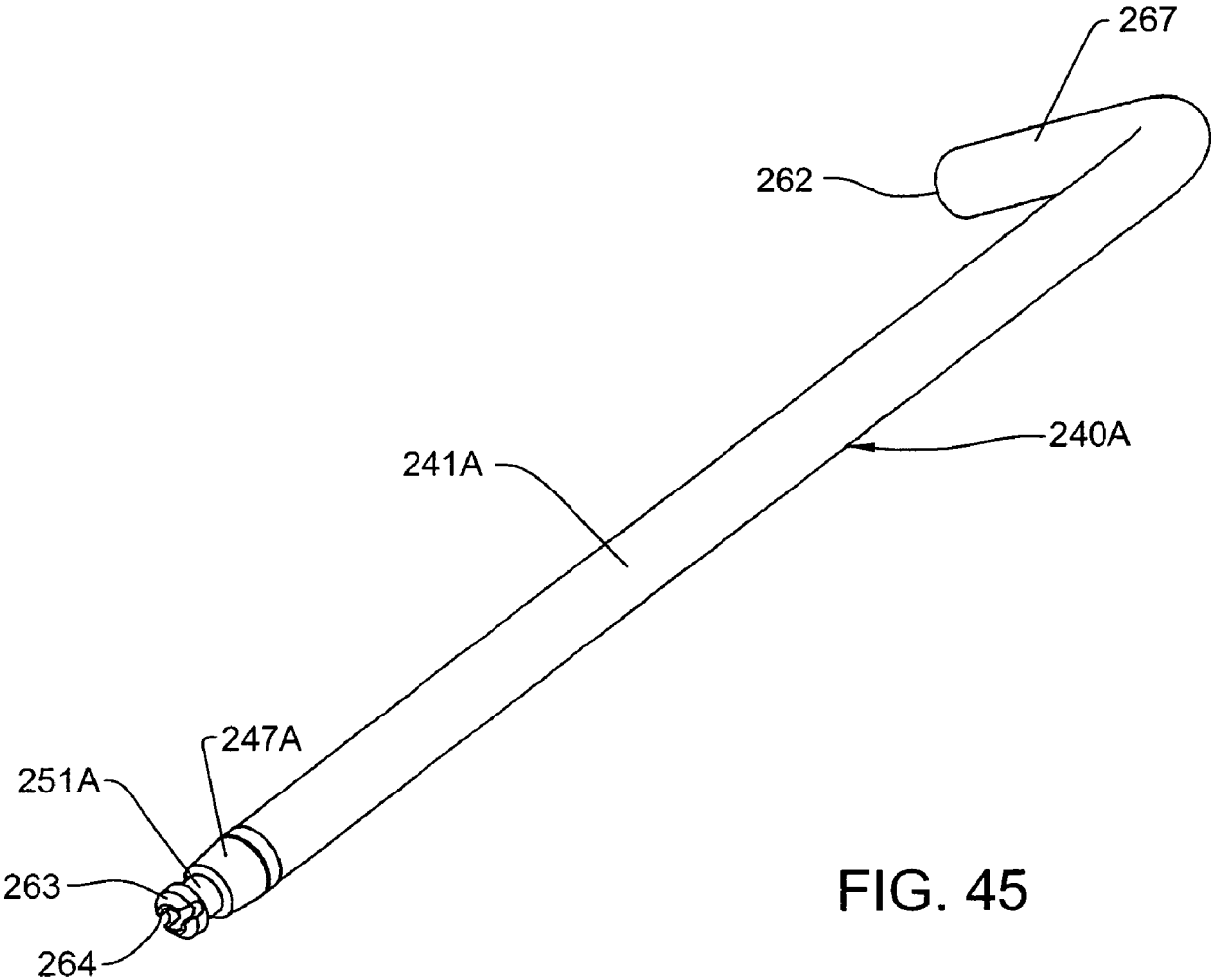
FIG. 45 is an isometric view of a modified push bar having an L-shape as shown in broken lines in FIG. 1.

Referring to FIG. 1 again, each of the push rods 240 can be, if desired, provided as L-shaped push rods 240A as illustrated in broken lines. An isometric view of an L-shaped push rod 240A is illustrated in FIG. 45. The end of the push rod 240A remote from the ambulance cot 10 can be terminated in a flat end 262 as shown or a ball can be provided similar to the ball 244 shown in FIGS. 40-44. An extension sleeve 247A is essentially identical to the extension sleeve 247 described above except that the distal end 263 thereof includes a laterally extending slot 264 in the axial end face thereof. The bracket 211A into which the modified push bar 240A is received is essentially identical to the bracket 211 described above. Nevertheless, the same reference numerals utilized for describing the bracket 211 have been utilized to describe the modified bracket 211A, except that the suffix "A" has been added to each reference numeral. This will make it unnecessary to describe in detail each of the features of the bracket 211A.

Figure 46:
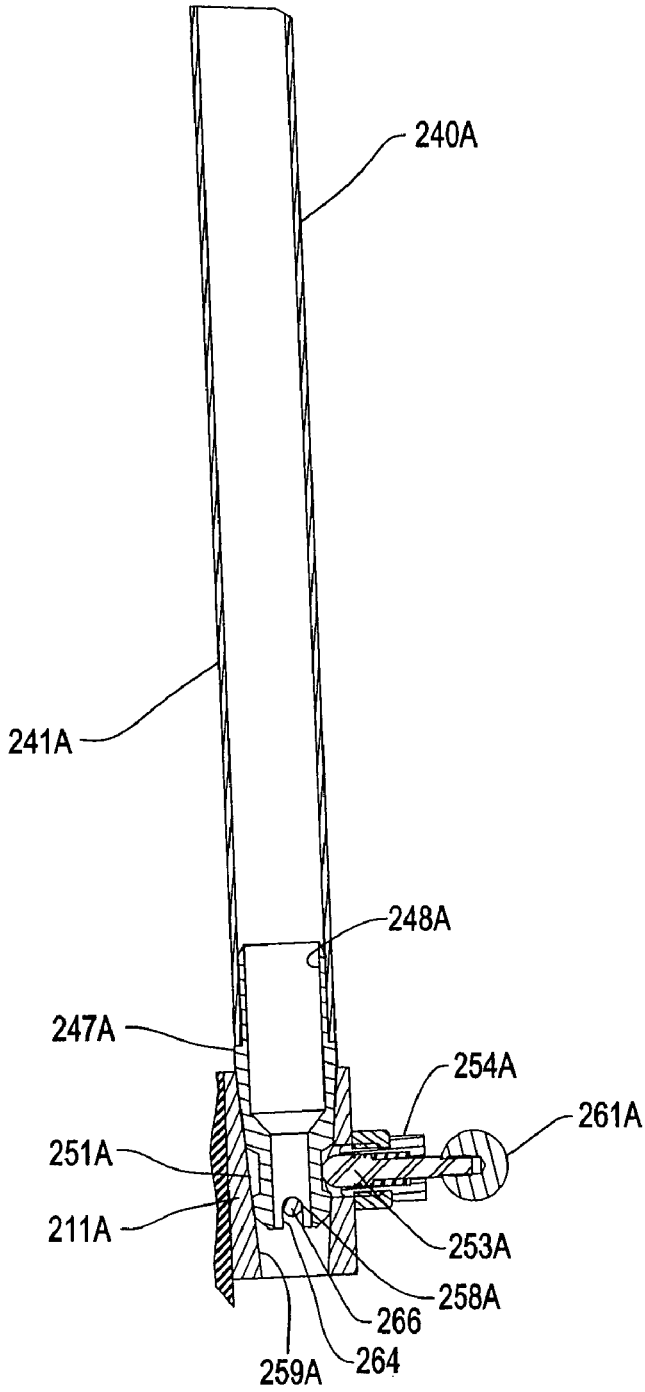
FIG. 46 is a longitudinal sectional view through a modified push bar locking mechanism for accommodating an L-shaped push bar.

The socket 259A in each of the brackets 211A includes a laterally extending pin 266 oriented at a location just beneath a plane containing the horizontal axis of the pin 253A. As the push bar 240A enters the respective socket 259A, the pin 266 will be received into the laterally extending slot 264 in the distal end of the extension sleeve 247A as illustrated in FIG. 46.

The longitudinal axis of the laterally extending pin 266 is parallel to the leg 267 of the push bar 240A. As a result, the legs 267 can extend laterally outwardly from the lateral sides of the ambulance cot 10 as illustrated at the head end thereof in FIG. 1 or they can extend laterally toward one another as illustrated in broken lines at the foot end of the ambulance cot 10 illustrated in FIG. 1. In order to manipulate the legs 267 between their respective positions illustrated in FIG. 1, it will be necessary for an attendant to pull on the knob 261A to retract the pin 253A into the sleeve 254A so that the push bars 240A can be lifted out of the socket 259A, rotated 180° and inserted back into the socket 259A so that the inner end 258A of the pin 253A can enter the annular groove 251A provided in the extension sleeve 247A.

Although particular preferred embodiments of the invention have been disclosed in detail for illustrative purposes, it will be recognized that variations or modifications of the disclosed apparatus, including the rearrangement of parts, lie within the scope of the present invention.

What is claimed is:

1. An ambulance cot, comprising:

a wheeled base;

a patient litter, said patient litter comprising:

a pair of hollow, laterally spaced, longitudinally extending side rails, said side rails being configured to extend from a head end to a foot end of the patient litter;

at least one retractable, generally U-shaped litter section with at least one hand grip oriented thereon adjacent a bight portion thereof, the legs of said U-shaped litter section being configured to be slidably received into the interior of the respective longitudinally extending side rails, each said parallel legs having first and second sections and a hinge configuration interconnecting said first and second sections together, said hinge configuration being oriented off-set from a central axis of said first and second sections; and a locking mechanism for releasably locking said first and second sections together so as to prevent relative movement therebetween and for unlocking the connection so as to permit a relative movement therebetween about an axis of said hinge configuration, whereby when said U-shaped litter section is in an extended position and said latch mechanism is in an unlocked condition, said first and second sections will be moveable with respect to one another to orient said hand grip at a different elevation.

2. The ambulance cot according to claim 1, wherein said hinge configuration includes a first pivot axis oriented generally perpendicular to a longitudinal axis of said first and second sections, wherein said locking mechanism includes a latch member pivotally secured to one of said first and second sections for movement about a second pivot axis that is parallel to said first pivot axis.

3. The ambulance cot according to claim 2, wherein said latch member includes a flange segment that is configured to engage a wall section of the other of said first and second sections to prevent relative movement between said first and second sections about said hinge configuration.

4. The ambulance cot according to claim 2, wherein said latch member includes a spring for continually urging said latch member toward a position to prevent relative movement between said first and second sections about said hinge configuration.

5. An ambulance cot, comprising:

a wheeled base;

a patient litter, said patient litter comprising:

a pair of hollow, laterally spaced, longitudinally extending side rails, said side rails being configured to extend from a head end to a foot end of the patient litter;

at least one retractable, generally U-shaped litter section with at least one hand grip oriented thereon adjacent a bight portion thereof, the legs of said U-shaped litter section being configured to be slidably received into the interior of the respective longitudinally extending side rails, each said parallel legs having first and second sections and a hinge configuration interconnecting said first and second sections together; and a locking mechanism for releasably locking said first and second sections together so as to prevent relative movement therebetween and for unlocking the connection so as to permit a relative movement therebetween about an axis of said hinge configuration, whereby when said U-shaped litter section is in an extended position and said latch mechanism is in an unlocked condition, said first and second sections will be moveable with respect to one another to orient said hand grip at a different elevation; and wherein said U-shaped litter section is configured to be locked in either an extended position or a retracted position by a further latch mechanism, wherein said further latch mechanism is connected by an elongate flexible member to a manually engageable member to facilitate the release of the further latch mechanism, said flexible member being connected to said latch member to effect a simultaneous movement of said latch member in response to said manual manipulation of said manually engageable member.

6. The ambulance cot according to claim 5, wherein said latch member includes a guide for guiding said flexible member inside said hollow first and second sections.

7. An ambulance cot, comprising:

a wheeled base;

a patient litter, said patient litter comprising:

a pair of hollow, laterally spaced, longitudinally extending side rails, said side rails being configured to extend from a head end to a foot end of the patient litter;

at least one retractable, generally U-shaped litter section with at least one hand grip oriented thereon adjacent a bight portion thereof, the legs of said U-shaped litter section being configured to be slidably received into the interior of the respective longitudinally extending side rails, each said parallel legs having first and second sections and a hinge configuration interconnecting said first and second sections together;

a locking mechanism for releasably locking said first and second sections together so as to prevent relative movement therebetween and for unlocking the connection so as to permit a relative movement therebetween about an axis of said hinge configuration, whereby when said U-shaped litter section is in an extended position and said latch mechanism is in an unlocked condition, said first and second sections will be moveable with respect to one another to orient said hand grip at a different elevation; and wherein said first and second sections are each hollow and wherein said locking mechanism is oriented internally of said first and second sections at the juncture between said first and second sections.

* * * * *